US011944174B2

(12) United States Patent
Carballeira et al.

(10) Patent No.: US 11,944,174 B2
(45) Date of Patent: Apr. 2, 2024

(54) UNIT OF LUGGAGE CONFIGURED TO ASCERTAIN ITS OWN WEIGHT

(71) Applicant: Smart Luggage One, Inc., Miami, FL (US)

(72) Inventors: Alberto Carballeira, Miami, FL (US); Robert Brady, Sarasota, FL (US); Anthony James Kelbert, Venice, FL (US); Matt Vergin, St. Petersburg, FL (US)

(73) Assignee: Smart Luggage One, Inc., Miami, FL (US)

( * ) Notice: Subject to any disclaimer, the term of this patent is extended or adjusted under 35 U.S.C. 154(b) by 0 days.

(21) Appl. No.: 18/243,718

(22) Filed: Sep. 8, 2023

(65) Prior Publication Data

US 2023/0413964 A1 Dec. 28, 2023

Related U.S. Application Data

(63) Continuation-in-part of application No. 17/194,475, filed on Mar. 8, 2021, now abandoned.
(Continued)

(51) Int. Cl.
*A45C 13/00* (2006.01)
*A45C 5/14* (2006.01)

(52) U.S. Cl.
CPC ..... *A45C 13/001* (2013.01); *A45C 5/14* (2013.01); *A45C 2005/148* (2013.01); *A45C 2200/05* (2013.01)

(58) Field of Classification Search
CPC ... A45C 13/001; A45C 5/14; A45C 2005/148; A45C 2200/05
See application file for complete search history.

(56) References Cited

U.S. PATENT DOCUMENTS 9,770,084 B1 9/2017 Shiekh
10,018,497 B2 * 7/2018 Lu ..... G01G 19/52
(Continued)

FOREIGN PATENT DOCUMENTS

CN 203860607 U 10/2014
CN 205456707 8/2016
(Continued)

OTHER PUBLICATIONS

Top 6: Best Smart Luggage [2020] Suitcases With Charging Ports for Travel; Nov. 1, 2020; https://www.youtube.com/watch?v=19iUS1n4aE8.

*Primary Examiner* — Tri M Mai
(74) *Attorney, Agent, or Firm* — Allen, Dyer, Doppelt & Gilchrist, P.A.

(57) ABSTRACT

A unit of luggage configured to ascertain its own weight. The unit of luggage comprises a detection assembly with one sensor assembly disposed around each wheel. Each sensor assembly comprises a housing assembly and a shaft disposed therein. The sensor assembly comprises a sensor housing, a cylinder housing and a cylinder. A load cell sensor is generally disposed within the sensor housing and is operatively disposed adjacent to the shaft such that it may engage the sensor and cause an upward deflection that generates a stress indicative of the weight of the unit of luggage being transferred to the particular, corresponding wheel. The cylinder housing is disposed below the sensor housing and encloses the cylinder, which itself encloses the shaft. A frictional resistance between the shaft and the cylinder permits a controlled movement of the shaft therein and permits a processing unit to ascertain a corresponding weight reading.

25 Claims, 17 Drawing Sheets

Related U.S. Application Data

(60) Provisional application No. 63/006,179, filed on Apr. 7, 2020.

(56) References Cited

U.S. PATENT DOCUMENTS

| | | | |
|---|---|---|---|
| 10,039,362 | B2 | 8/2018 | O'Hare |
| 11,215,498 | B2 | 1/2022 | Karl |
| 2021/0239513 | A1 | 8/2021 | Karl |

FOREIGN PATENT DOCUMENTS

| | | | | |
|---|---|---|---|---|
| CN | 107884048 | A | | 4/2018 |
| CN | 108741509 | A | | 11/2018 |
| CN | 108741513 | A | | 11/2018 |
| CN | 114224048 | A | * | 3/2022 |

* cited by examiner

UNIT OF LUGGAGE CONFIGURED TO ASCERTAIN ITS OWN WEIGHT

FIELD OF INVENTION

The present invention relates to the field of luggage units comprising electronic features.

BACKGROUND

Existing pieces of luggage generally do not generally provide for a convenient way to ascertain and display their own weight. Standalone mechanical and electronic scales have various drawbacks, including their lack of accuracy, and the fact that they are generally not an integral component of the luggage units themselves. Further drawback associated with weight scales and existing pieces of luggage involve the fact that even if both are provided, it is often difficult to visually determine an accurate weight reading, especially in connection with mechanical scales.

Accordingly, there is a need in the industry for a smart luggage assembly capable of automatically ascertaining its own weight, including via a variety of mechanical and/or electrical components. A benefit in the industry would be realized by providing a smart luggage assembly with a built in detection assembly that could ascertain the weight of the luggage and conveniently display it on the luggage itself. A further benefit would be provided by providing a smart luggage assembly with a solar panel capable of transforming solar energy into electricity for the functioning of various operative components of the smart luggage assembly. An even further benefit would be provided by providing a smart luggage assembly that may be cooperatively configured with a user platform to effectively manage the weight of the smart luggage assembly and compare it to air carrier requirements and guidelines.

SUMMARY

The present invention is directed towards a smart luggage assembly and to a method of using a user platform to check its weight and ensure conformance to airline carrier requirements and guidelines. The smart luggage assembly comprises a case with one or more independent segments. The smart luggage assembly also comprises a detection assembly configured to ascertain the weight associated with an independent segment(s). The smart luggage assembly further comprises a service assembly configured to display the overall weight of the case. Furthermore, the innovative smart luggage assembly may be cooperatively configured with a user platform to conveniently access information related to the weight of one or more smart luggage assemblies.

As mentioned above, the innovative smart luggage assembly may comprise a case with one or more independent segments. When two independent segments are provided, such may be pivotally movable with respect to one another and may be collectively disposed into and out of a closed position and an open position. Alternatively, a case may be provided comprising only one independent segment. Various mechanisms, e.g., zippers, may be provided to provide access to an inside of the case or an independent segment(s), or to otherwise provide a closing mechanism to the smart luggage assembly.

As also mentioned above, the smart luggage assembly comprises a detection assembly configured to ascertain information relating to the weight of one or more smart luggage assemblies. An independent segment may comprise a detection assembly disposed thereon, for example on or around a bottom portion of the case. The detection assembly may comprise a weight sensor, which may be for example a mechanical scale or an electronic weight sensor. Accordingly, the weight sensor may be configured to ascertain the weight associated with one or more segments of the case of a smart luggage assembly.

In embodiments of the smart luggage assembly comprising a built in mechanical scale, a downward vertical displacement of the weight sensor, with respect to the wheels and/or bottom portion of a case, are indicative of a specific weight associated with a particular travel configuration of the smart luggage assembly. For example, a substantially neutral position of the weight sensor(s) and the bottom portion of the case with respect to its wheels is indicative of only the weight of the case, without contents on an inside thereof. Conversely, a substantially lowered position of the weight sensor(s) and the bottom of the case with respect to its wheels is indicative of the well of the case as well as the weight of items or contents disposed on an inside thereof, which substantially occupy the entire capacity of the case. Other intermediate positions of the weight sensor(s) and the bottom portion of the case with respect to the position of the wheels, are indicative of the weight of the case and the weight of some items or contents disposed on an inside thereof, but which do not fully occupy the capacity of the case.

The service assembly of the innovative smart luggage assembly is generally configured to display information associated with the weight of an independent segment(s). The service assembly may comprise a display configured to show the overall weight of the case, including the weight of the items or contents disposed on an inside of the casing. The display may also be configured to show the overall weight of only one independent segment. Thus, an operative connection may be established between the detection assembly and the service assembly, for example between the weight sensor(s) and the display.

The service assembly may also comprise solar sensor. It is within the scope of the present invention that the smart luggage assembly comprise powering capabilities intended to provide electricity to the various operative components of the smart luggage assembly. Thus, the smart luggage assembly may comprise one or more rechargeable battery units. The solar sensor may be configured to capture solar energy and transform it into electricity that may be conveyed to a battery unit to replenish its charge, or alternatively such electricity may be transmitted directly to the operative components of the smart luggage assembly.

Further features of the present invention comprise implementing wireless capabilities to transmit weight data associated with one or more smart luggage assemblies. For example, weight data may be transmitted directly from the detection assembly to the display, from the detection assembly to a mobile or desktop device, or from the display to a mobile or desktop device. As will be explained below, the present invention also contemplates providing a user platform, which may be accessed via a variety of devices, mobile devices and/or desktop computers, to access weight data associated with one or more innovative smart luggage assemblies. A database accessible by the user platform may be continuously updated with data associated with the current and/or actual weight of one or more smart luggage assemblies.

Even further features of the present invention comprise incorporating real-time aviation information to the user platform. Such aviation information may be included in a real time database that may be accessed via the user platform. Accordingly, such aviation information may comprise commercial airline restrictions as to the number and weight of the luggage that may be checked in during a flight or that may be transported as a carry on item(s). Thus, the user platform may be accessed to compare whether the weight data associated with one or more given smart luggage assemblies comports to these travel requirements and/or guidelines from air carriers, or whether there should be made some adjustments to ensure conformance.

Additional features of the present invention comprise providing a unit of luggage configured to ascertain its own weight a mechanical mechanism that accounts for the weight of the luggage when the unit of luggage is disposed in a substantially upright position. Accordingly, the unit of luggage may be provided with a detection assembly comprising a plurality of sensor assemblies, each one disposed around a corresponding wheel of the unit of luggage. Each one of the plurality of sensor assemblies generally comprises a shaft configured to reciprocally move, upward and downward, with respect to a housing assembly. The housing assembly is generally connected to and reciprocally moves with the case of the unit of luggage when it is disposed in the substantially upright position. Conversely, the shaft is connected to one of the wheels of the unit of luggage at one and is adjacently disposed to an underside of the sensor at the other end. The shaft is also structured to achieve a vertical movement within the housing assembly that is intendent of the vertical movement of the case and the housing assembly according to the weight of the unit of luggage or the case with items disposed therein, e.g., clothing, personal articles, etc.

The housing assembly generally comprises a sensor housing, a cylinder housing and a cylinder. The sensor housing is generally structured to enclose a load cell sensor inside of a sidewall. The cylinder housing is disposed below the sensor housing and is generally structure to enclose a cylinder, which itself is structured to enclose the shaft. The cylinder housing and the sensor housing are generally disposed in non-movable relation to one another and may be integrally formed. The cylinder may be disposed within the cylinder housing and its vertical position may be adjusted according to the specific need, but should otherwise be disposed in non-movable relation to the cylinder and to the sensor housing. The shaft may comprise an elongated shape, including with a substantially cylindrical cross section(s) and is generally configured to define a frictional resistance with the interior of the cylinder.

Thus, when in the substantially vertical position, the housing assembly and the case should move downward with respect to the shaft and the wheel of the unit of luggage. Such downward travel of the housing and the case with respect of the shaft and the connected wheel generally depends on the weight of the unit of luggage and may be at least partially reduced, limited or attenuated by the frictional resistance generated between the shaft and the cylinder. This is advantageous given that changes in the weight of the unit of luggage may be accounted by small variations in the position of the housing and case with respect to the shaft, e.g., with calibration of the load cell sensors according to such positional variations. Accordingly, when the unit of luggage is disposed in a substantially upright position, the case and the housing assembly may move downward with respect to the shaft such that the shaft may induce an upward deflection of the sensor relative to the vertical plane given its proximity. Said differently, the weight of the unit of luggage should cause the shaft to engage, and at least cause a deflection on, a stem of the load cell sensor that generates a stress that may be interpreted by and/or communicated to the processing unit. Such a stress is generally representative of a portion of the weight of the unit of luggage that corresponds to the weight being transferred to a particular wheel. The total of the readings of all of the weights ascertained by each sensor assembly should be representative of the overall weight of the unit of luggage.

DETAILED DESCRIPTION

Figure 1:
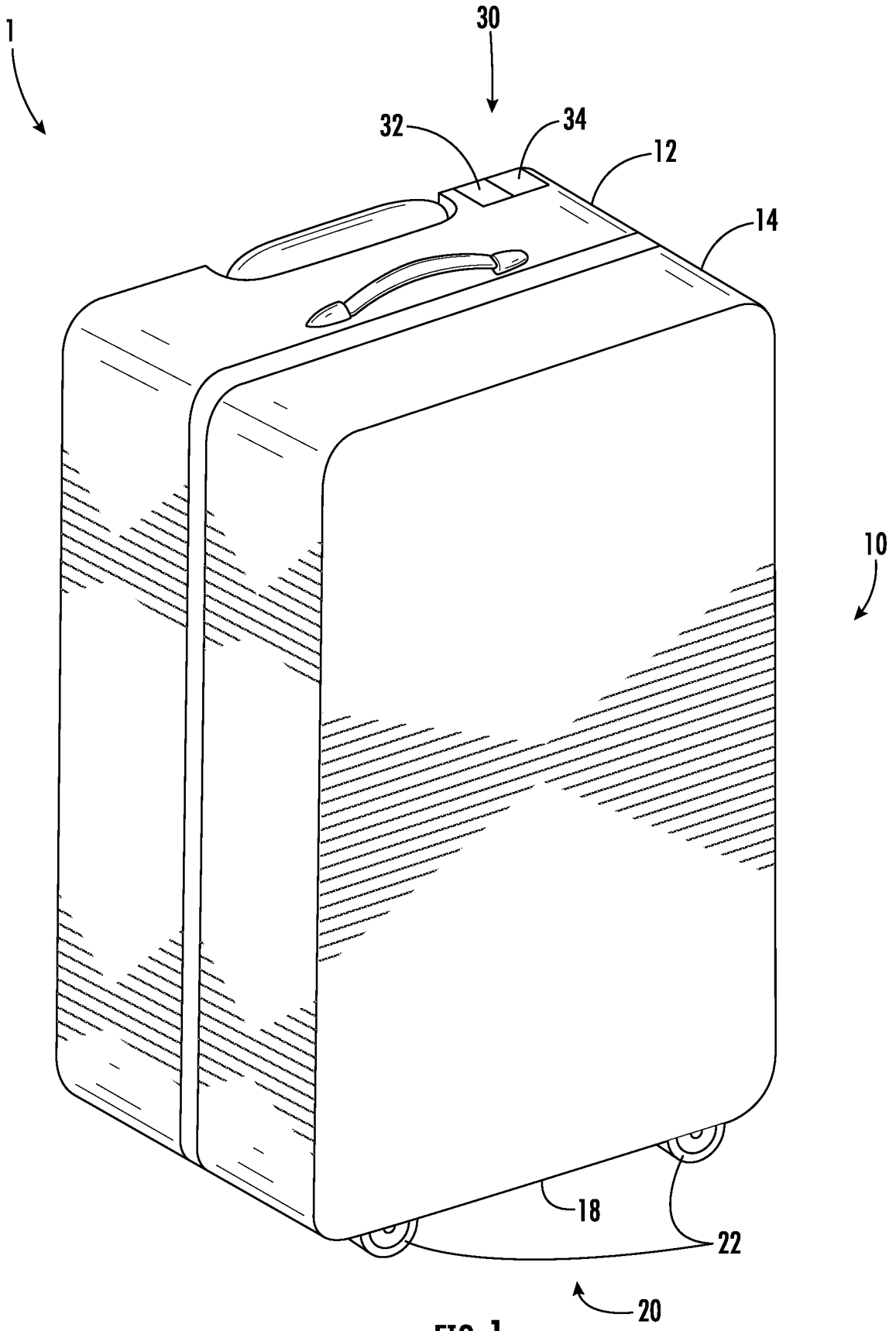
FIG. 1 is a perspective view of one embodiment of the smart luggage assembly disposed in a closed position.
Figure 2:
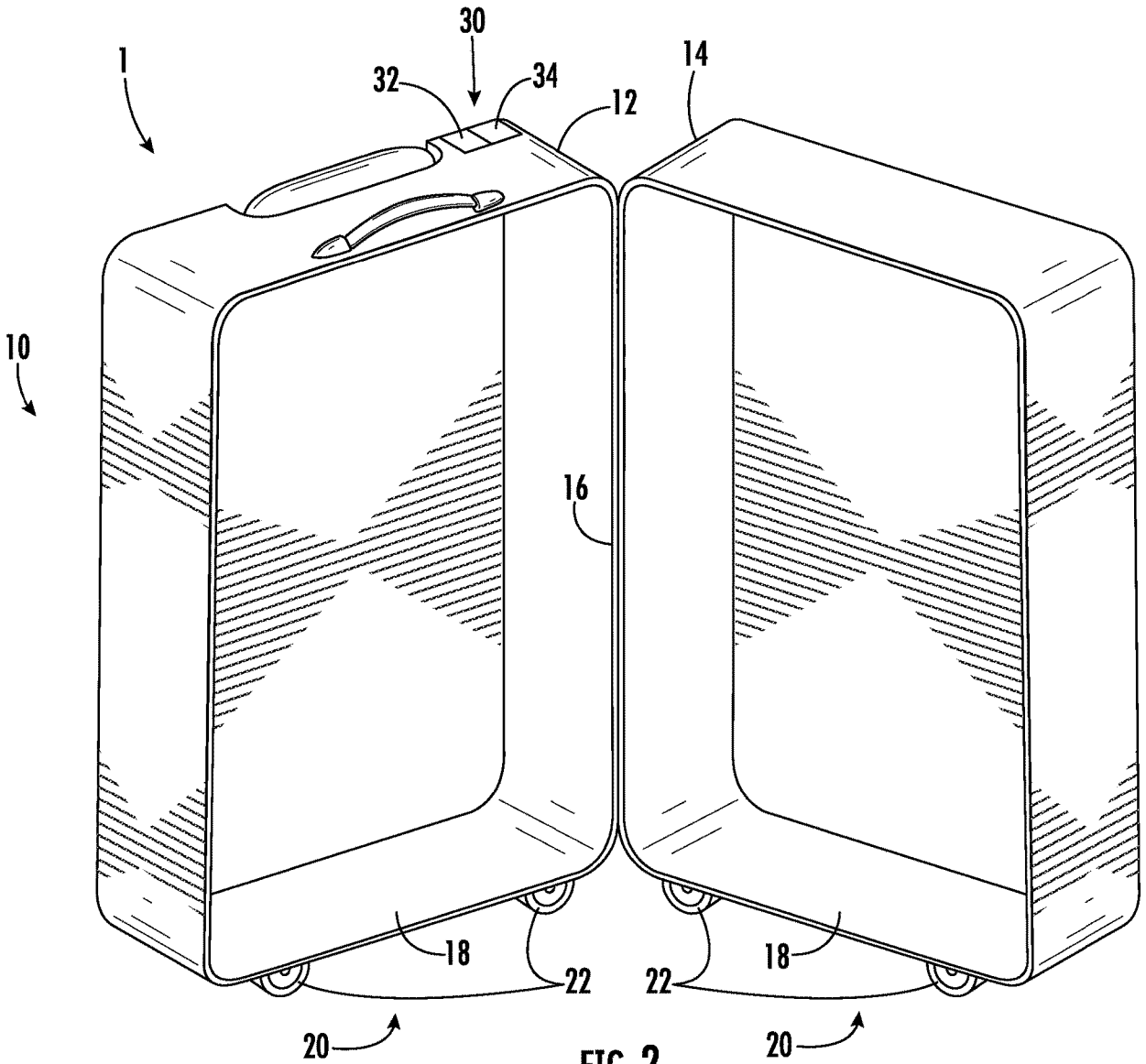
FIG. 2 is a perspective view of another embodiment of the smart luggage assembly disposed in an open position.
Figure 5:
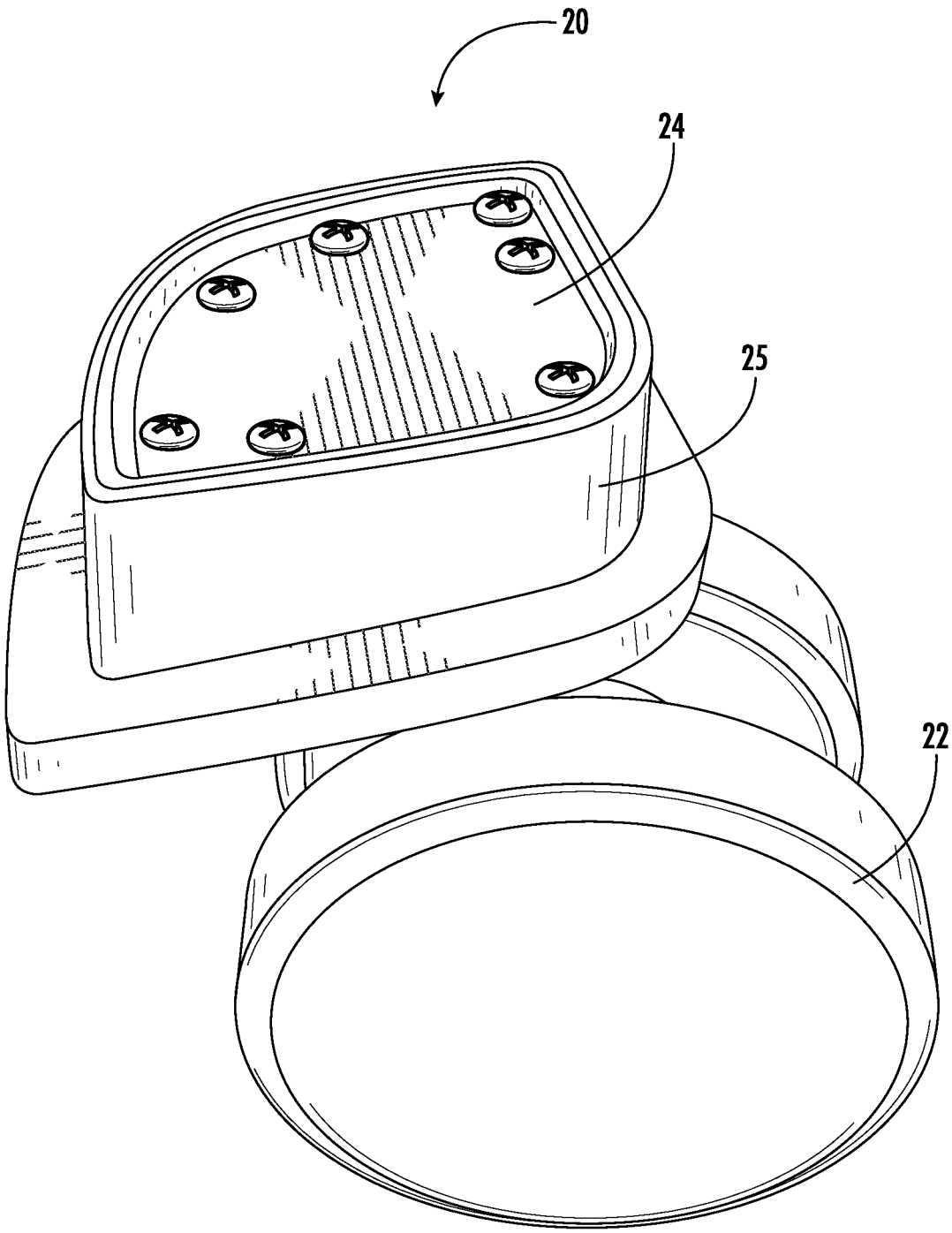
FIG. 5 is a perspective view of one embodiment of the detection assembly according to the smart luggage assembly of the present invention.
Figure 6:
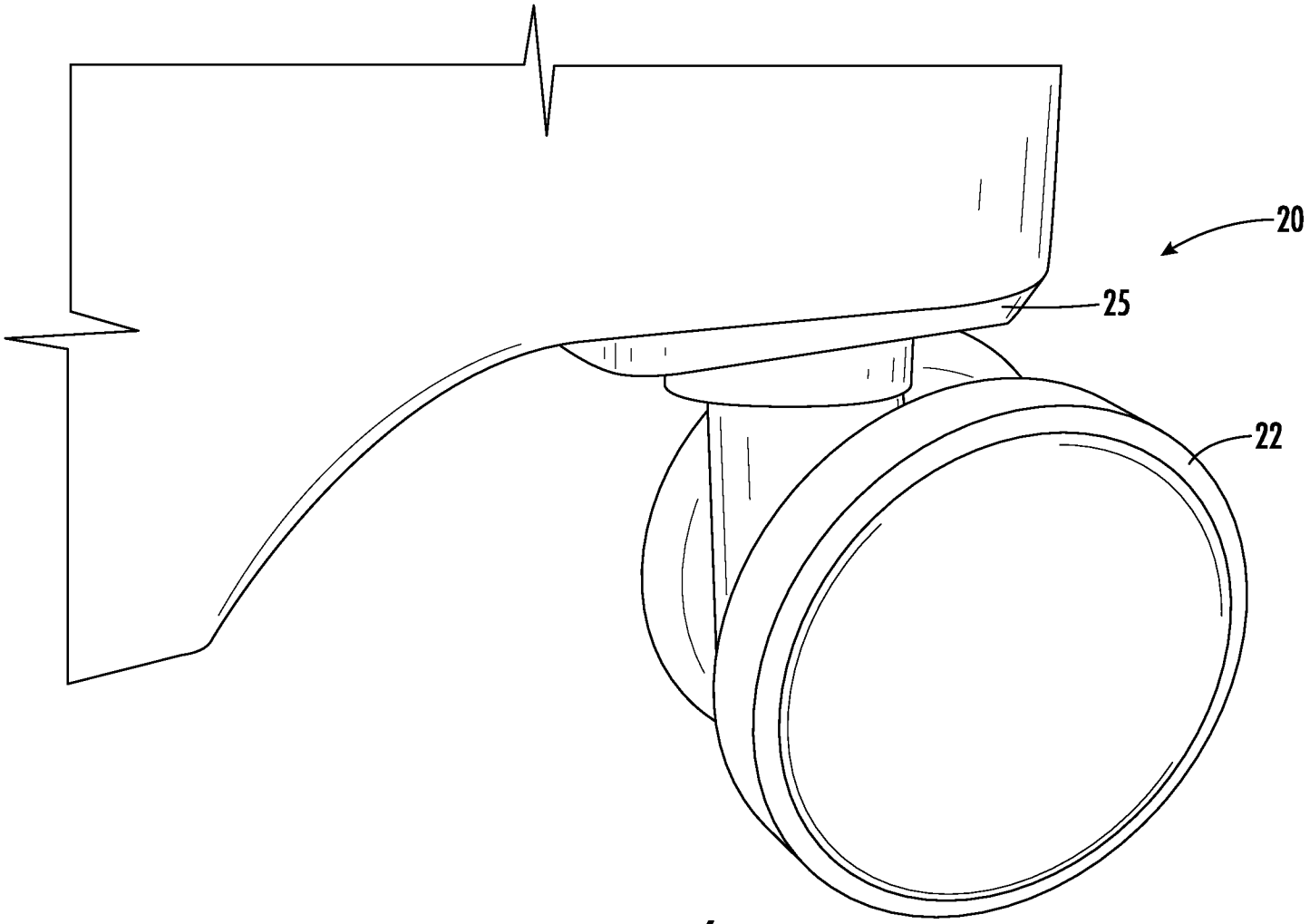
FIG. 6 is a perspective view of another embodiment of the detection assembly according to the smart luggage assembly of the present invention.

With initial reference to FIGS. 1-2, the present invention is directed towards a smart luggage assembly 1. With reference also to FIG. 5, the present invention is also directed towards a method 100 of using a user platform to ensure that the weight and number of smart unit assemblies 1 conforms to airline carrier requirements and guidelines. The smart luggage assembly 1 according to the present invention is intended to ascertain its own weight when it is empty, and when items are disposed on an inside thereof. The smart luggage assembly 1 comprises a case 10 having at least one independent segment, e.g. a first independent segment 12 and/or a second independent 14. As is perhaps best shown in FIG. 2, the smart luggage assembly 1 may comprise two independent segments, namely a first independent segment 12 and a second independent segment 14. The smart luggage assembly 1 further comprises a detection assembly 20. The detection assembly 20 is configured to ascertain the overall weight of the smart luggage assembly 1. The detection assembly 20 may be configured to ascertain the weight around the independent segment(s) 12 and/or 14 of the case 10. Additionally, the smart luggage assembly 1 comprises a service assembly 30 configured to display the overall weight of the case 10. As will be explained herein, one or more smart luggage assemblies 1 may be cooperatively configured with a user platform to conveniently access information associated weight information.

As mentioned above, and as shown at least in FIGS. 1-2, the smart luggage assembly 1 comprises a case 10 with at least one independent segment. It is within the scope of the present invention that the smart luggage assembly 1 may comprise a case 10 with two independent segments 12 and 14. The independent segments 12 and 14 may be connected along a longitudinal seam 16, which allows pivotal movement of the independent segments 12 and 14. For example, the seam 16 may allow for pivotal movement between the independent segments 12 and 14, between a closed position, as represented in FIG. 1, to an open position, as represented in FIG. 2. However, this is not strictly necessary, as other configurations are also possible. As a non-limiting example, the case 10 may include a single independent segment with a lid that may be opened with a zipper or other related mechanism.

As also mentioned above and as is shown in FIGS. 1-2, the smart luggage assembly 1 comprises a detection assembly 20. With particular reference to FIG. 2, each segment, e.g., 12 and/or 14, of the case, may comprise a detection assembly 20 disposed thereon, for example in a bottom portion 18 of the first independent segment 12 and/or second independent segment 14. As is perhaps best shown in FIGS. 3-4, in at least one embodiment according to the present invention, the detection assembly 20 may comprise a weight sensor 24 disposed around a bottom portion 18. A weight sensor(s) 24 may be disposed around a corresponding wheel 22 of the smart luggage assembly 1. It is within the scope of the present invention that at least two wheels 22 be disposed on each independent segment, e.g., 12 and/or 14, so as to at least partially enable stability and/or facilitate movement of a smart luggage assembly 1. Thus, the weight sensor 24 may comprise a built-in mechanical scale and/or an electronic weight sensor, either of which may be configured to determine the composite weight of each independent segment 12 and/or 14. As used herein, the composite weight of an independent segment refers to the overall weight of the independent segment 12 and/or 14 with items or contents disposed on an inside thereof.

Figure 3:
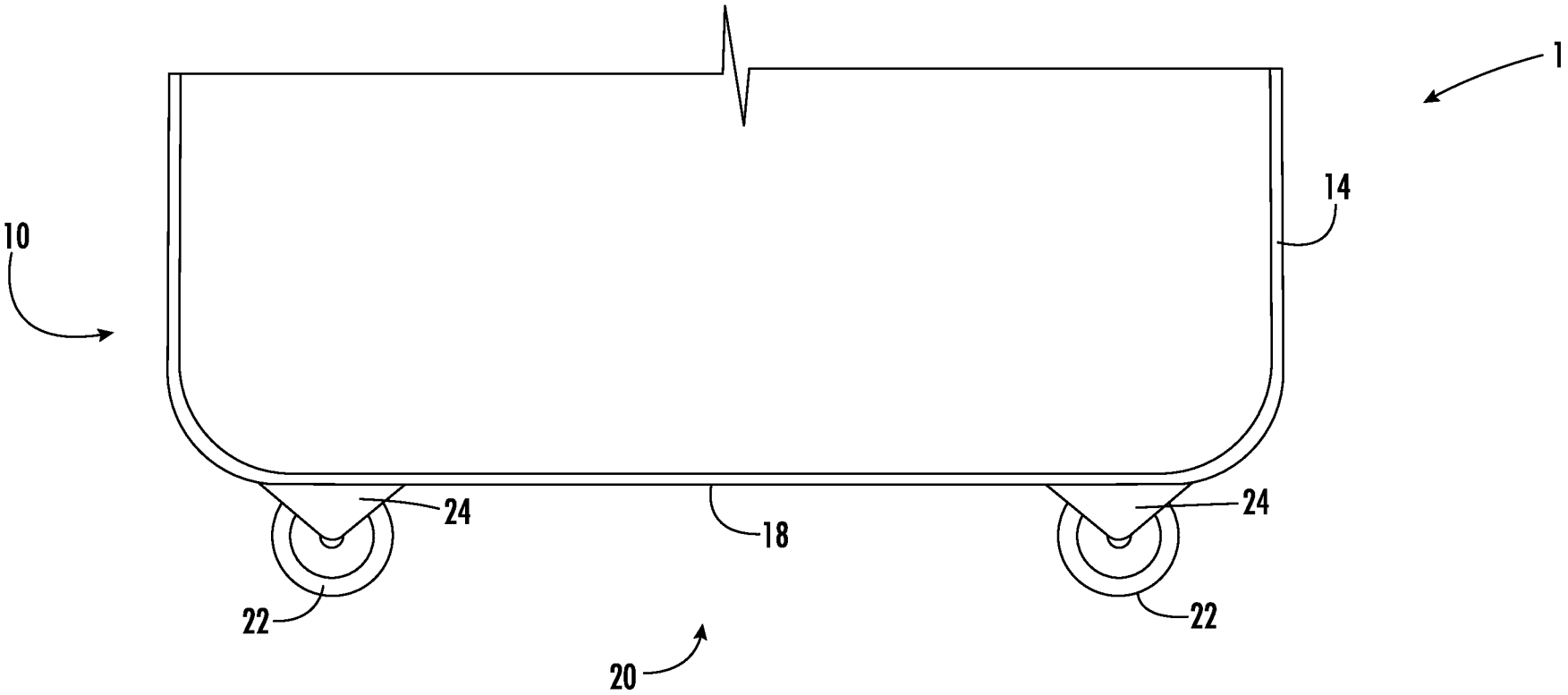
FIG. 3 is a front view of a portion of one embodiment of an independent segment of the smart luggage assembly where the weight sensors are shown in a substantially neutral position.
Figure 4:
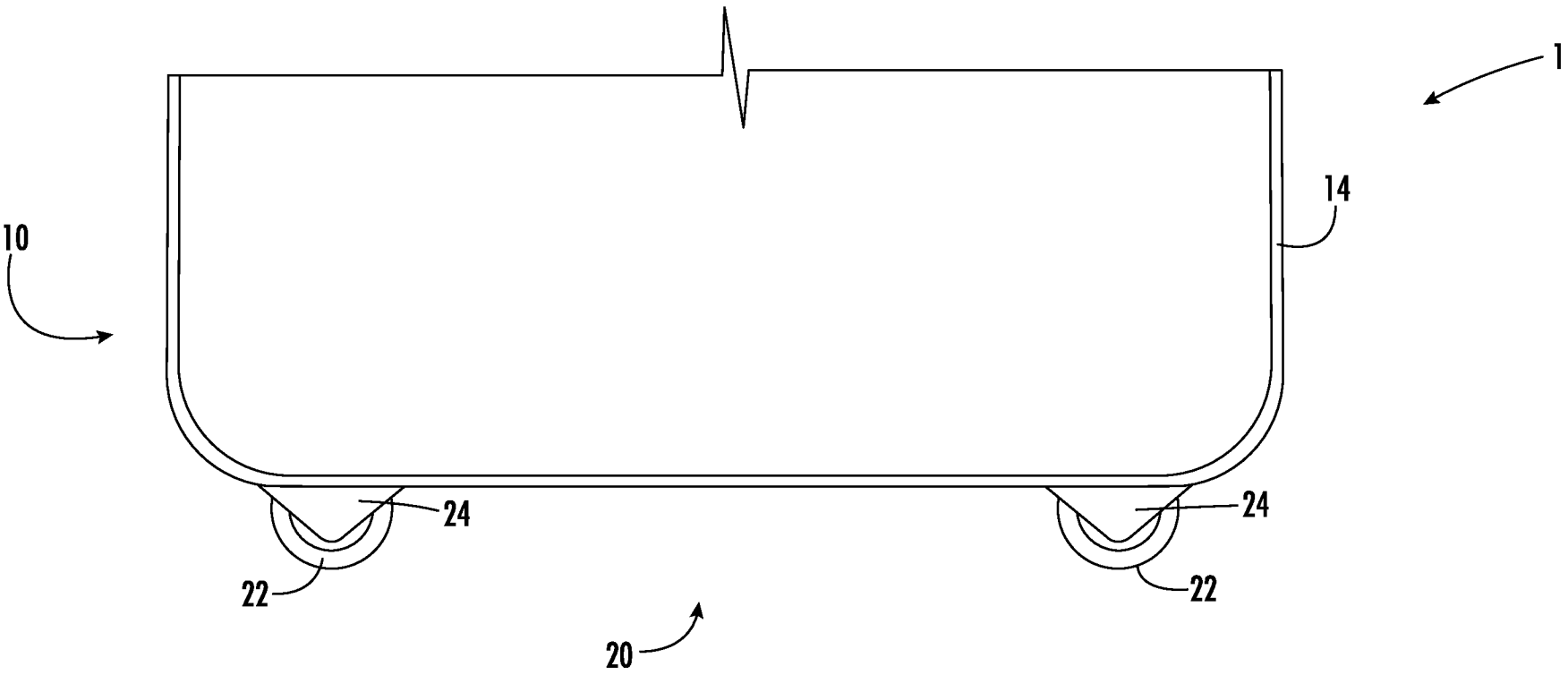
FIG. 4 is a front view of a portion of another embodiment of an independent segment of the smart luggage assembly where the weight sensors are shown in a substantially lowered position.

With reference to FIGS. 3-4, in at least one illustrative embodiment of the present invention, the weight sensor 24 may comprise a built-in mechanical scale disposed around the wheels 22 of the smart luggage assembly 1. In such embodiments, it is within the scope of the present invention that a downward displacement of the vertical position of at least the bottom portion 18 of the case 10 be indicative of the overall weight associated with an independent segment 12 and/or 14. For example, the illustrative embodiment as represented in FIG. 3 shows a substantially neutral position of the weight sensors 24, and the bottom portion 18, with respect to the vertical position of the wheels 22. Thus, in the illustrative embodiment represented in FIG. 3, such a substantially neutral position of the weight sensor 24 and the bottom portion 18 is substantially indicative of only the weight of only the case 10, i.e., without items on an inside thereof. Conversely, the illustrative embodiment as represented in FIG. 4 shows a substantially lowered position of the weight sensors 24, and the bottom portion 18, with respect to the vertical position of the wheels 22. In the illustrative embodiment represented in FIG. 4, such a substantially lowered position of the weight sensors 24 and the bottom portion 18 is substantially indicative of the composite weight of the case 10, i.e., the weight of the case 10 as well as the weight of items or contents disposed on an inside thereof, which substantially occupy the entire capacity of both independent segments 12 and 14 of the case 10. It is also possible to achieve intermediate vertical positions of the weight sensor 24, which are indicative of the weight of an independent segment 12 and/or 14 with some items or contents disposed thereon, but which occupy some capacity of the independent segments 12 and/or 14, but not their full capacity.

The electronic weight sensor(s) 24 may comprise a variety of sensor technologies. As an illustrative example, the weight sensor(s) 24 may comprise a load cell, e.g., a force transducer, which is configured to convert compression or pressure into an electrical signal that may be measured and/or standardized. For example, as a force applied to the load cell increases, the electrical signal may change proportionally. Thereafter the electrical signal(s) may be processed and/or converted into a corresponding weight value. As a further example, a force sensing resistor (FSR) may be incorporated. A force sensing resistor (FSR) may comprise a material configured to change its resistance when a force, pressure, or mechanical stress is applied. The change in resistance may be converted into an electrical signal, e.g., via the processing unit 40. The size and/or shape of the electronic weight sensor(s) 24 may be dimensioned and configured according to the specific size of the wheels 22 and/or case 10.

Figure 7:
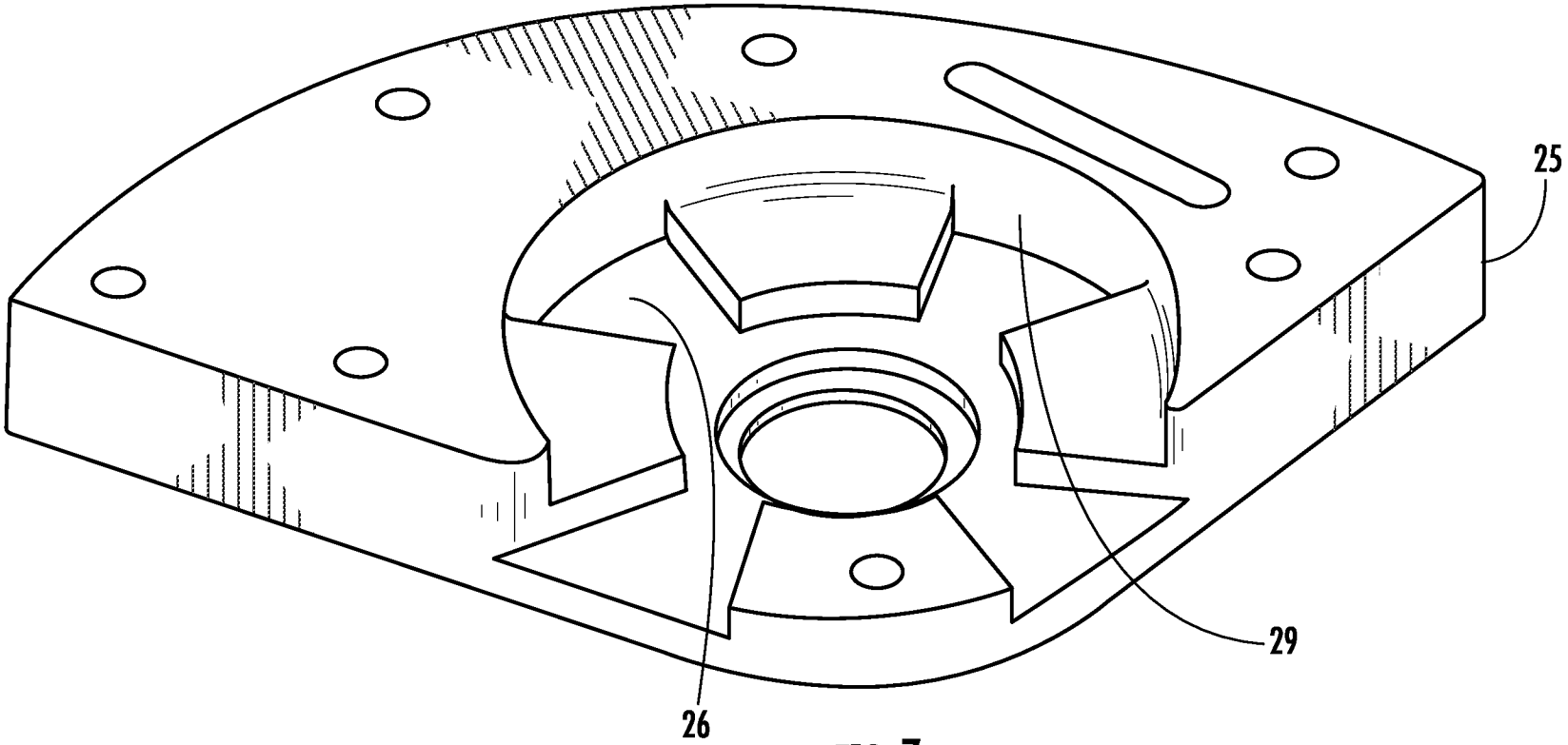
FIG. 7 is a perspective view of one embodiment of a retainer of the detection assembly according to the smart luggage assembly of the present invention.
Figure 8:
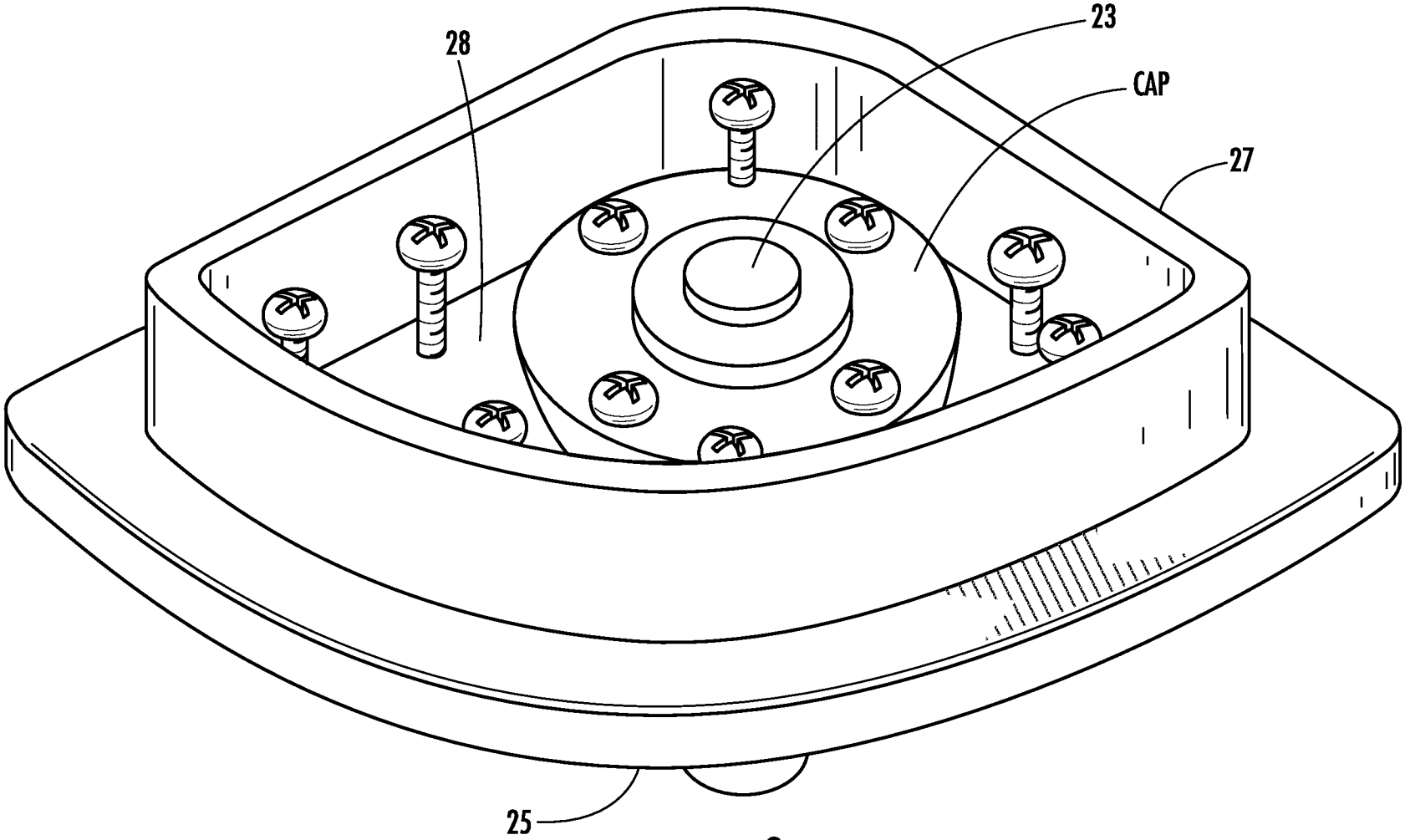
FIG. 8 is a perspective view of another embodiment of a retainer of the detection assembly according to the smart luggage assembly of the present invention.
Figure 9:
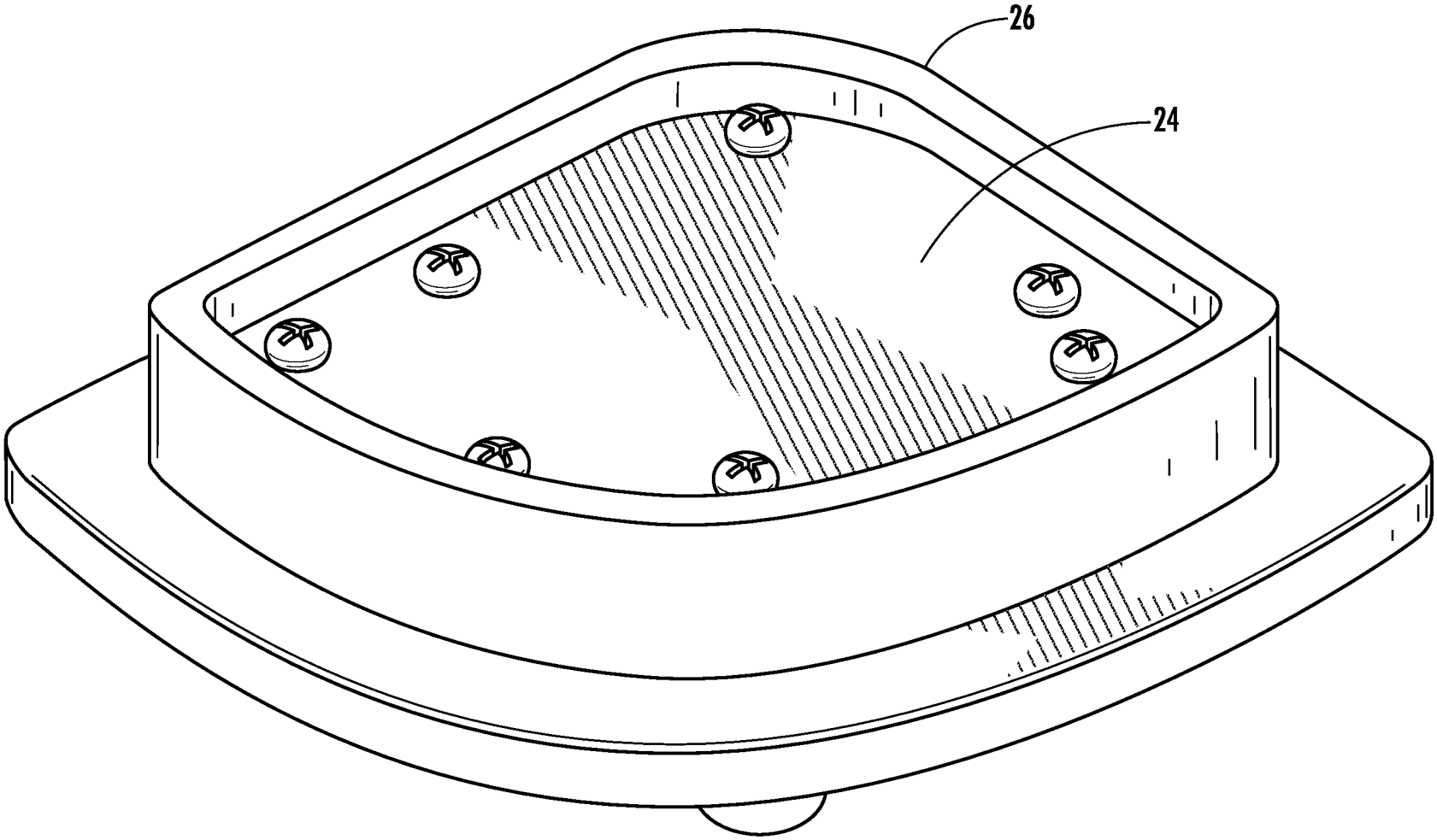
FIG. 9 is a perspective view of yet another embodiment of a retainer of the detection assembly according to the smart luggage assembly of the present invention.
Figure 10:
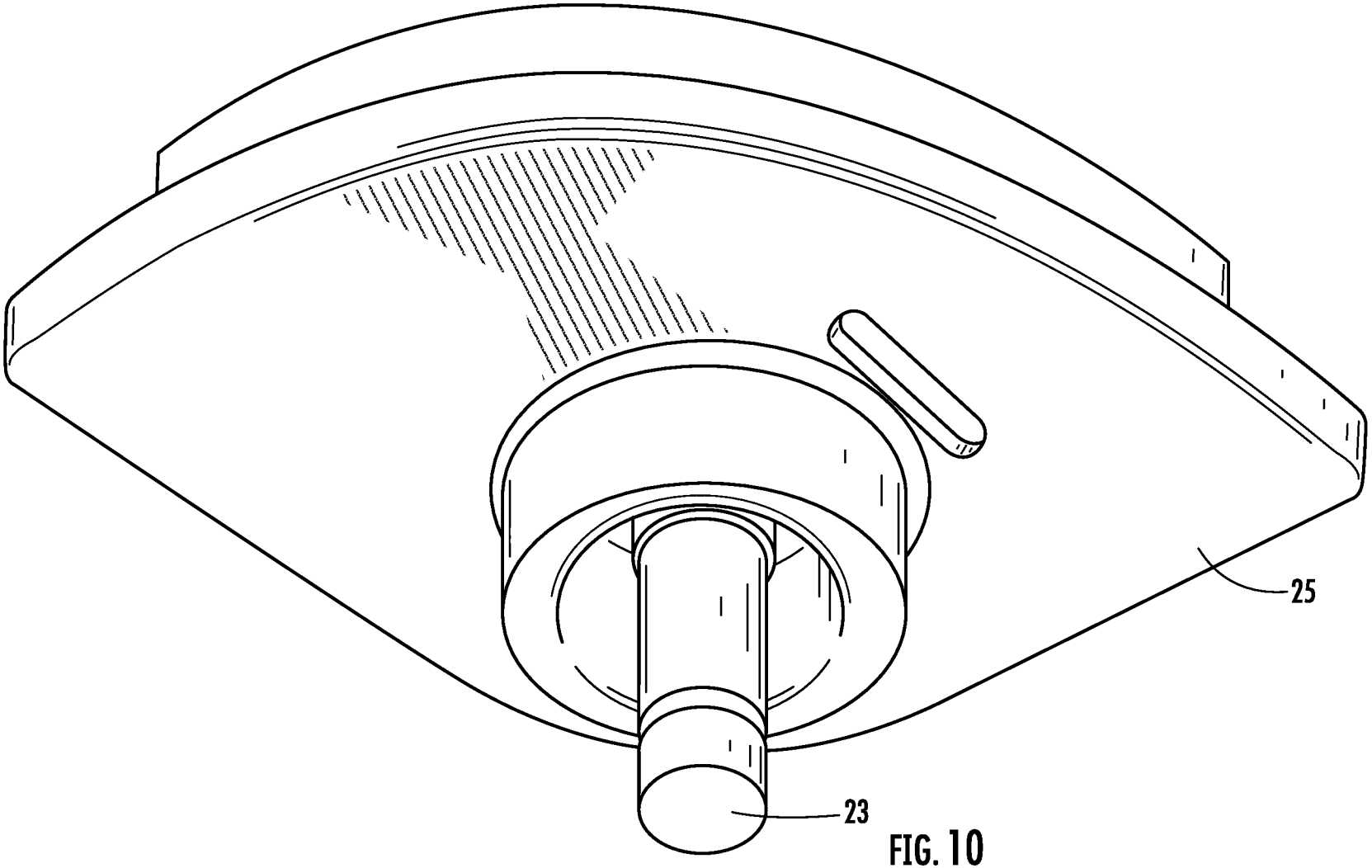
FIG. 10 is a perspective view of an even further embodiment of a retainer of the detection assembly according to the smart luggage assembly of the present invention.

With reference to the illustrative embodiments of FIGS. 5-10, the smart luggage assembly 10 may comprise a plurality of retainers 25. Each retainer 25 is intended to interconnect a corresponding wheel 22 to at least a portion of the case 10. Furthermore, each retainer is also intended to retain and/or house a corresponding weight sensor 24. As shown in FIG. 7, each retainer 25 may comprise a socket 26 where various components of a corresponding wheel 22 may be disposed. For example, as shown in FIG. 8, a cap and/or a wheel connecting portion 23 and/or attendant components may be disposed on the socket 26 and/or an aperture disposed around the socket 26. As is also shown in FIG. 8, each retainer 25 may comprise a sidewall 27 configured and dimensioned to substantially define an enclosure 28. It is within the scope of the present invention that the height of the sidewall be sufficient to accommodate not only the wheel connecting portion 23 and/or its attendant components, i.e., cap, screws, etc., but also the weight sensor 24. For example, as shown in the illustrative embodiment of FIG. 9, a weight sensor 24 may be disposed on the enclosure 28, and the weight sensor itself may be at least partially surrounded by the sidewall 27. As shown in FIG. 10, a wheel connecting portion 23 may extend and protrude or otherwise project to an opposite side of the retainer 25. The wheel connecting portion 23 may be used to connect to the wheel 22 itself.

Figure 11:
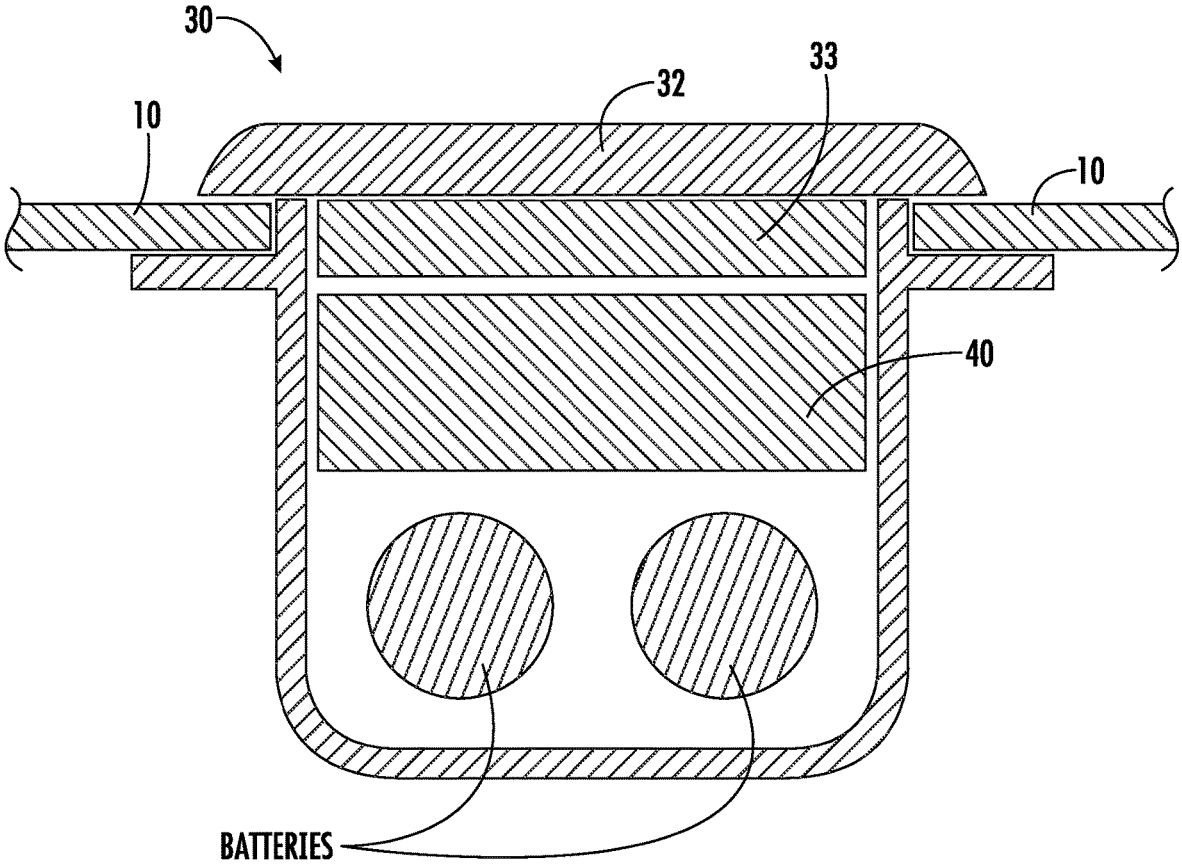
FIG. 11 is a side cross-sectional view of one embodiment of the service assembly according to the smart luggage assembly of the present invention.
Figure 12:
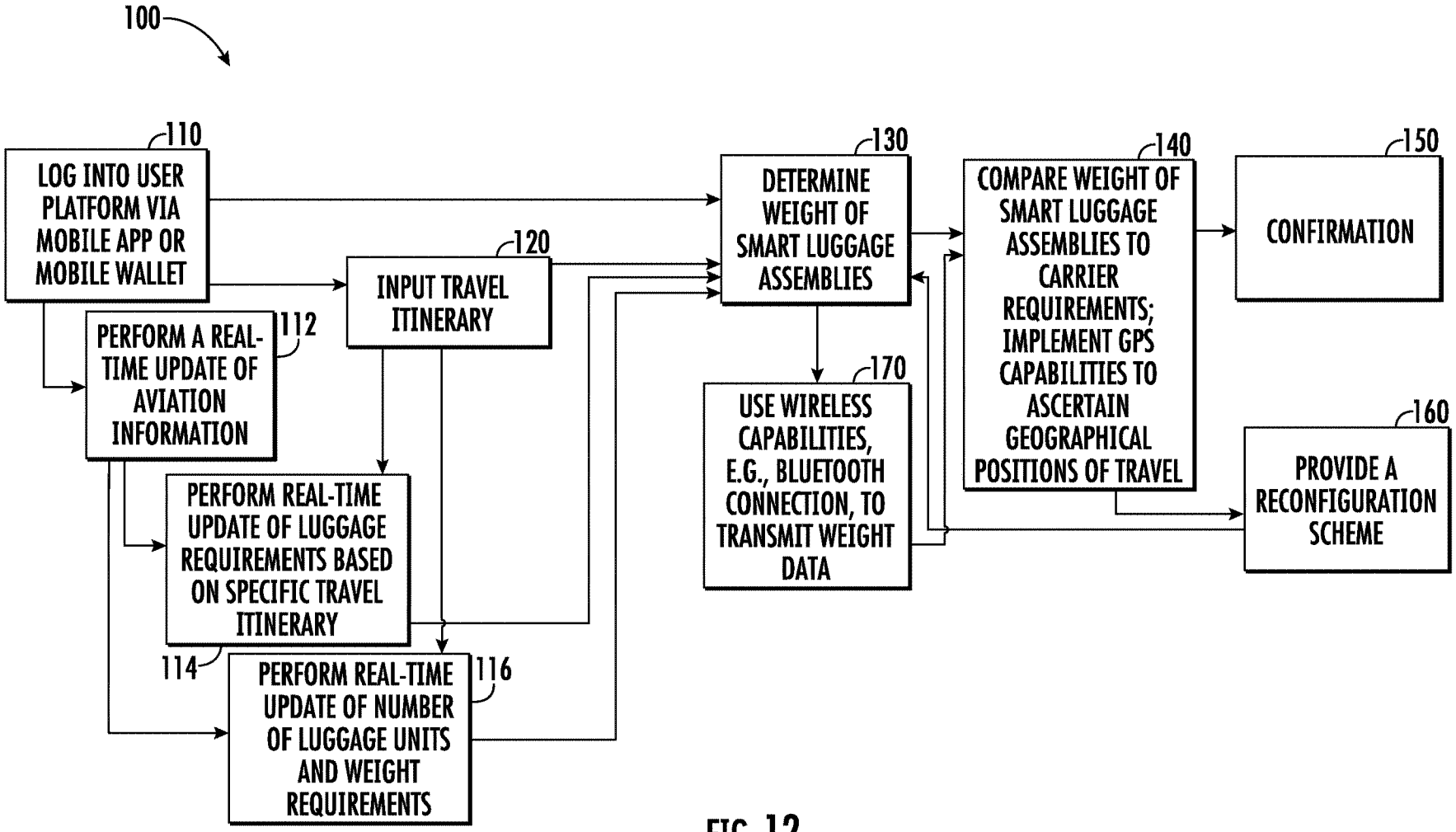
FIG. 12 is a diagrammatic representation of the method according to the present invention of using a user platform to verify the weight of a smart luggage unit(s).

As is shown in the illustrative embodiments of at least FIG. 11, the present invention comprises a processing unit 40. The processing unit 40 and/or processing board 40 may comprise a microprocessor, which may be cooperatively configured with the weight sensor(s) 24, of the detection assembly 20 to convert a pressure, force, stress, or change thereof, into an electrical signal representative of an associated weight. Furthermore, the processing unit 40 may also be operatively configured with the service assembly 30, e.g. with a display 32, to show such weight as may be associated with the pressure, force, stress and/or change thereof. It is within the scope of the present invention that the processing unit 40 and/or components thereof comprise at least a minimum level of flexibility that allows for an integration into the pad 10 and/or sensor(s) 24. It is also within the scope of the present invention that the processing unit 40 be configured with a programmable code or executable computer software for the purposes of integrating the sensor(s) 24 and/or service assembly 30. The processing unit 40 may comprise an open-source hardware and/or software package that includes single-board microcontrollers and microcontroller kits. By way of example only, the processing unit 40 may comprise a processing board manufactured by Arduino, LLC, and/or under the brand Arduino®.

As may be appreciated from FIGS. 1-2 and 11, the present invention contemplates providing a service assembly 30. The service assembly 30 is primarily intended to serve as a mechanism to show information associated with the weight of an independent segment 12 and/or 14. As such, the service assembly 30 may comprise a display 32. For example, the service assembly may comprise an outer display 32 operatively configured with a display glass 33. The display 32 may be configured to show the overall weight of the case 10, including with items or contents disposed on an inside of the independent segments 12 and/or 14. Alternatively, the display 32 may also be configured to show the overall weight of only one of the independent segments 12 or 14. Such display configuration of only one of the independent segments 12 or 14 may be advantageous in order to assist in evenly distributing the weight of the items or contents on an inside of an independent segment 12 and/or 14. Thus, it is within the scope of the present invention that an operative connection be established between the detection assembly 20 and the service assembly 30. For example, an operative connection may be established between the weight sensor(s) 24 and the display 32 of the service assembly 30. Such operative connection may be enabled via wired configurations or wirelessly via a variety of technologies, including, Bluetooth®, Wi-Fi, LAN, Near-Field Communication (NFC) capabilities, and other related tools. Such operative connection may also be at least partially enabled via software or executable code, and by implementing a variety of hardware components including emitters, transmitters, routers, wires, cabling, etc. Such hardware components may be disposed in proximity respectively to the weight sensor(s) 24 and/or the display 32 of the service assembly 30.

With reference again to FIGS. 1-2, the service assembly 30 may also comprise solar sensor, which is indicated as 34. It is within the scope of the present invention that the smart luggage assembly 1 comprise powering capabilities. Such powering capabilities are intended to provide the necessary electricity for the functioning of the various operative components, including, the weight sensor(s) 24, the display 32, and/or the attendant components that enable an operative communication between them. Thus, the smart luggage assembly 1 may comprise one or more battery units, e.g., as shown in FIG. 11. The battery unit(s) may comprise rechargeable batteries and/or may be disposed on an inside of the case 10. Alternatively, and as is shown in FIGS. 1-2, the service assembly 30 may comprise a solar sensor 34. The solar sensor 34 may comprise a photovoltaic cell panel configured to capture solar energy and transform it into electricity. In at least one embodiment, the solar sensor 34 is configured to transform solar energy into electricity that will replenish the charge of a battery unit(s). In at least another embodiment, the electricity generated by the solar sensor 34 will be transmitted directly to the operative components of the smart luggage assembly 1, e.g., weight sensor(s) 24, the display 32, attendant components, etc. accordingly, the solar sensor 34 may be operatively connected with the processing unit 40 to provide electricity to the operative components of the smart luggage assembly 1.

Further features of the present invention comprise implementing wireless capabilities to transmit weight data associated with one or more smart luggage assemblies 1. Wireless capabilities, including, but not limited to, Bluetooth®, Wi-Fi, LAN, Near-Field Communication (NFC) capabilities, may be used to transmit data associated with the weight of one or more innovative smart luggage assemblies 1. For example, weight data may be transmitted directly from the detection assembly 20, i.e., via the weight sensor(s) 24, to the service assembly 30, i.e., to the display 32. The present invention also contemplates providing a user platform, as will be explained later, which may be accessed via a variety of devices, including mobile devices, in the form of a mobile application, and/or desktop computers via a web browser. As such, weight data may be transmitted wirelessly from the detection assembly 20 to the mobile or desktop device, for example via a server, data network, cloud computing, etc. The weight data may be similarly transmitted wirelessly from the service assembly 30 to a mobile or desktop device.

As mentioned above, further features of the present invention comprise providing a user platform. The user platform may be accessed by one or more users to access weight data associated with one or more innovative smart luggage assemblies 1. It is within the scope of the present invention that the user platform be continuously updated in "real-time", which generally may involve updating with up-to-date or recent information regarding the current and/or actual weight of a given smart luggage assembly 1. It is contemplated that such current and/or actual weight of a given smart luggage assembly 1 be ascertained and/or displayed with the components of the smart luggage assembly 1, e.g., sensors 24, processing unit 40, display 32, etc. The user platform may also be provided with global positioning system (GPS) tracking capabilities, as may be required in connection with planning and/or implementing a travel itinerary. Such GPS tracking capabilities may comprise internal hardware components disposed on a smart luggage assembly 1, for example, a receiver configured to obtain radio signals and ascertain a current location of one or more smart luggage assemblies 1. Such GPS tracking capabilities may also be used to ascertain a location of one or more smart luggage assemblies 1 if, for example, they are misplaced, lost, sent to an incorrect location, etc. Further, such GPS tracking capabilities may be configured to ascertain data relating to a specific location(s) of one or more smart luggage assemblies 1, including various positions of travel in connection with a travel itinerary. Such GPS data may be displayed on the user platform such that the owner of the smart luggage assembly 1 may determine its location at any given point.

Therefore, the user platform may be accessed by one or more users via an application installed on a mobile device to allow users to check real-time data associated with the weight of one or more smart luggage assemblies 1. Alternatively, and in addition to or in lieu of a standalone mobile application installed on a device, various features of the user platform may be conveniently accessed and/or stored on a device via a mobile wallet or through a web server(s) accessible via a mobile device.

Even further features of the present invention comprise incorporating real-time aviation information to the user platform. Such aviation information may be included in a real time database that may be accessed via the user platform. Accordingly, such aviation information may comprise commercial airline luggage restrictions, for example, number of allowed luggage units allowed on a given national or international flight, and its weight restrictions for on-board luggage and/or carry-on luggage. Such restrictions in the number and weight of luggage may vary according to each specific commercial airline and/or the nature of the underlying flight, for example whether it is within a state, within a country, between more than one country, and/or the estimated travel time. Accordingly, the user platform may be accessed to compare whether the weight data associated with one or more given smart luggage assemblies 1 comports to these travel requirements and/or guidelines from air carriers. If the smart luggage assemblies 1 do not comport to specific travel requirements or guidelines, the user platform may indicate which smart luggage assemblies 1 may need weight adjustments, and how much such adjustments may need to be. The user platform may also provide information associated with additional carrier fees associated with the current weight configuration of one or more smart luggage assemblies 1. Accordingly, it is within the scope of the present invention that the user platform be accessed to input specific travel information, e.g., airline, flight number, destination, city of origin, current flight, future flights, number of passengers, etc., and link this information with one or more smart luggage assemblies 1. As such, the user platform may provide for an efficient way to confirm that one or more travel configurations, that is one or more smart luggage assemblies 1 and their associated weight data, comport to the specific requirements associated with a specific travel itinerary. The user platform is also intended to be an easy to access resource to implement a weight reconfiguration scheme, i.e., to make weight adjustments to one or more smart luggage assemblies 1, as may become necessary to comport to such requirements and/or limit additional carrier fees associated with a specific travel itinerary.

With reference now to FIG. 5, and as mentioned above, the present invention is also directed towards a method 100 of ensuring that the weight and number of smart unit assemblies 1 associated with a given travel itinerary conform to specific requirements and guidelines of air carriers. Furthermore, embodiments of the method 100 further comprise incorporating the inventive smart luggage assembly 1 conformance to requirements and guidelines of air carriers. Accordingly, the method 100 comprises logging into a user platform as described herein. This may be accomplished via a mobile or desktop device, for example via a mobile application, web browser, or via a mobile wallet. The method 100 further comprises preforming a real-time update of aviation information 112 to the user platform. That is, a database accessibly by, or otherwise associated with, the user platform, may be updated with specific requirements and/or guidelines of air carriers, for example, commercial airlines, airport regulations, etc. The method 100 may comprise a user inputting a flight itinerary 120, and performing a real-time update of specific requirements and/or guidelines based on the specific travel or flight itinerary 114. As used herein, inputting a flight itinerary 120 may comprise synching, creating, or otherwise enabling a flight itinerary or travel ticket to be accessible via the user platform, and/or also by airport staff, e.g., airline staff, TSA, security, etc. Furthermore, the method may comprise performing a real-time update of the number and weight of permissible luggage units of a specific travel itinerary 116. The method 100 further comprises determining the weight of at least one smart luggage assembly 130. For example, the method 100 may comprise providing and using the smart luggage assembly 1 to determine the weight of at least one luggage unit 130.

Wireless capabilities, for example Bluetooth connectivity, may be used to transmit data relating to the weight of one or more smart luggage assemblies 170. For example, data relating to the weight or one or more smart luggage assemblies 170 may be transmitted from the electronic weight sensor assembly 1 to the user platform. Data relating to the weight of one or more smart luggage assemblies may also be transmitted, for example, to a server, data network, cloud computing, etc., of the air carrier. For example, data relating to the weight of a luggage unit(s) may be associated with a travel itinerary or an actual ticket, e.g., a ticket that may be printed or that be accessed through a mobile app, mobile wallet, web browser, etc. The method 100 further comprises comparing the weight data of the smart luggage assemblies to air carrier requirements and guidelines 140. For example, it is within the scope of the present invention that the air carrier staff and/or airport staff, have immediate access to the data relating to the weight of a one or more smart luggage assemblies 1, for example, prior to arrival at the airport. This may at least partially reduce the amount of time associated with baggage check-in, and may also reduce the time and effort the staff will have otherwise needed to weight one or more smart luggage assemblies 1 upon arrival at the airport. This may also at least partially reduce the staff's physical contact with the smart luggage assembly 1 or assemblies 1 and may be used to expedite luggage check-in procedures, for example, via first class travel, pre-approved check-in, TSA, etc. For example, a curbside check-in kiosk, or an inside check-in kiosk, may have access to the weight of a unit(s) of luggage the moment a user uses the electronic weight sensor assembly 1 to ascertain the weight thereof. As an example, the user may access the user platform to record or otherwise save a weight reading of the smart unit assembly 1 of a unit of luggage(s), and that information may be linked or associated with a ticket or travel itinerary in real-time.

In addition, as shown at 140, GPS capabilities may also be implemented to determine a geographical position in connection with a travel itinerary. If the actual weight and number of the smart luggage assemblies is in conformance to the air carrier requirements and guidelines, the method 100 comprises providing a confirmation 150. If the actual weight and number of the smart luggage assemblies is not in conformance to the air carrier requirements and guidelines, the method 100 may comprise implementing or providing a reconfiguration scheme 160. It is contemplated that with a reconfiguration scheme, that the user adjust the weight and/or number of the smart luggage assemblies 1 such that their weight may be determined again to verify and/or ensure conformance to the air carrier requirements and guidelines. For example, the reconfiguration scheme 160 may comprise an alarm sent to the user via the user platform, i.e., on a mobile application or a mobile wallet, and it may also indicate which smart luggage assembly 1 may not conform to the specific travel requirements and/or guidelines. This process may be repeated until the weight and/or number of the smart luggage assemblies are in conformance with the air carrier requirements.

Further features of the method 100 according to the present invention comprise providing an alert upon the occurrence of a predetermined condition. Such an alert may be sent, for example, when the weight of a smart luggage assembly 1 increases beyond conformance with the carrier requirements for each specific travel itinerary. In such cases, a reconfiguration scheme 160 may be implemented and a new reading of actual weight may be ascertained to ensure conformance to the requirements. Additionally, an alert may also be sent if there are any changes in the weight of the smart luggage assembly 1 beyond a predetermined threshold, e.g., 3 lbs. or 5 lbs. An alert may also be sent if the smart luggage assembly 1 is misplaced or lost, or if is located beyond a predetermined radius from the location of the user, e.g., as indicated by the location of the user's mobile phone accessing the using platform via a mobile application.

Figure 13:
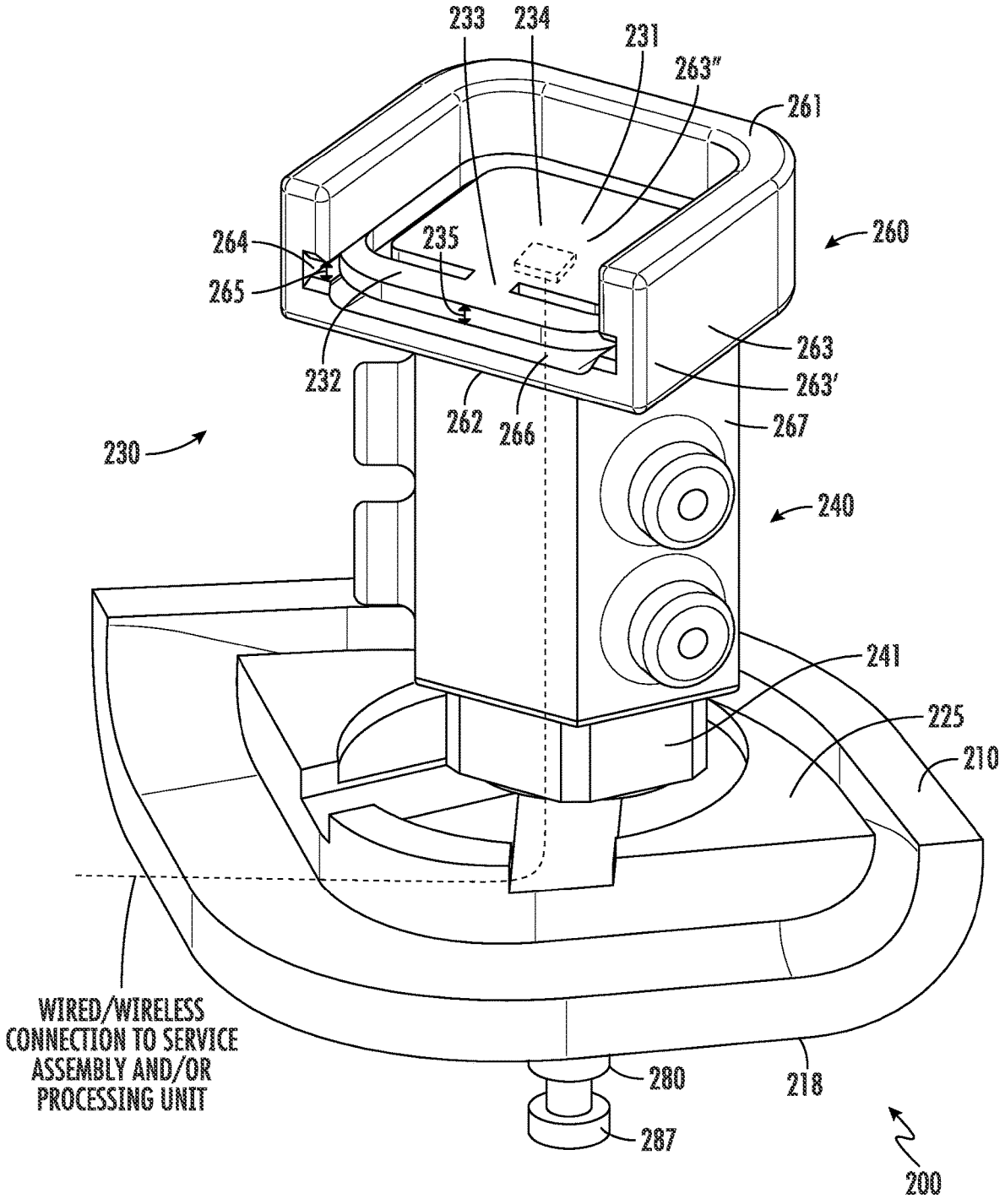
FIG. 13 is a perspective view of one embodiment of a sensor assembly according to the FIG. 14 is a perspective view of a cross-section of one embodiment of a sensor assembly according to the luggage unit of the present invention.
Figure 14:
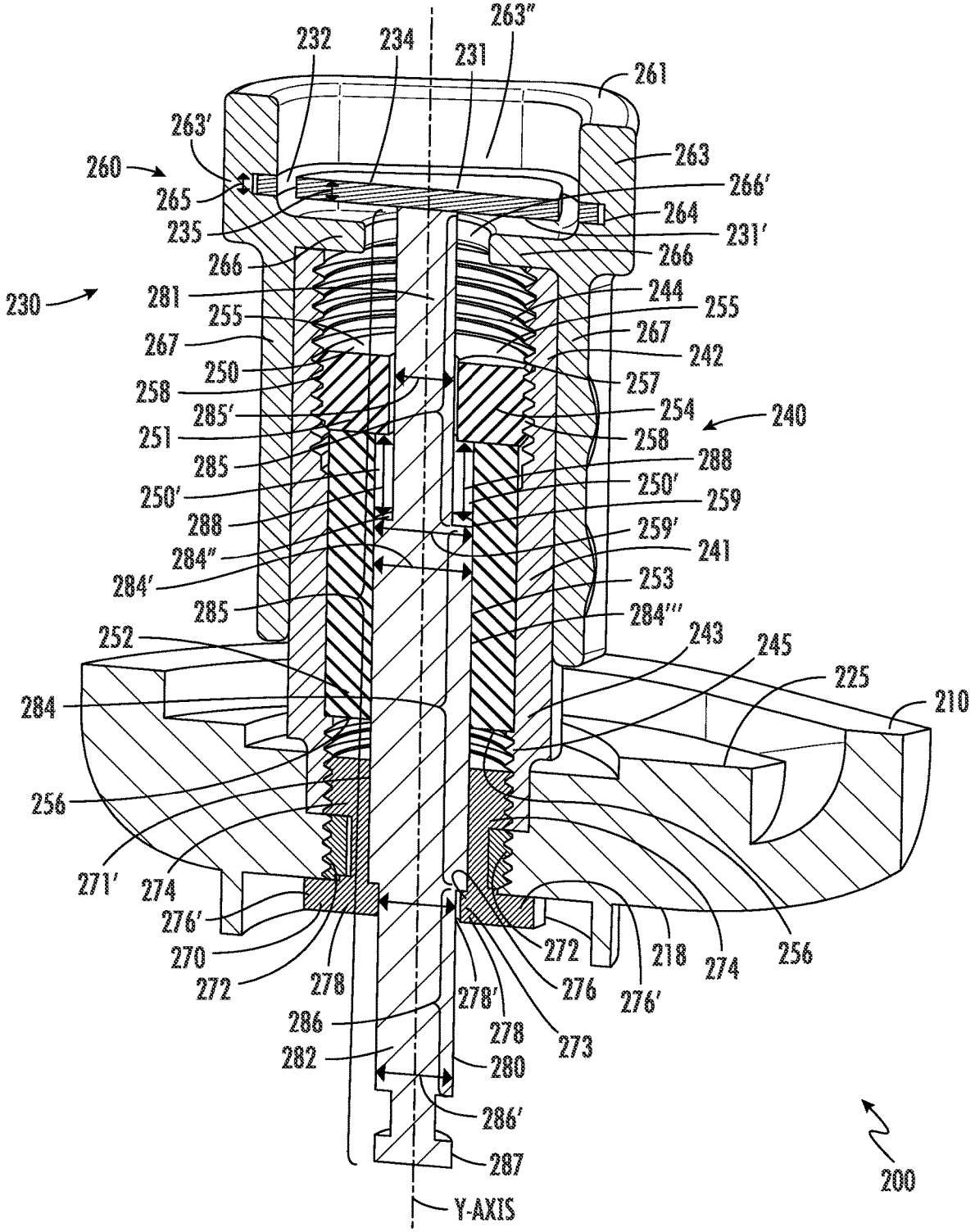
Figure 15:
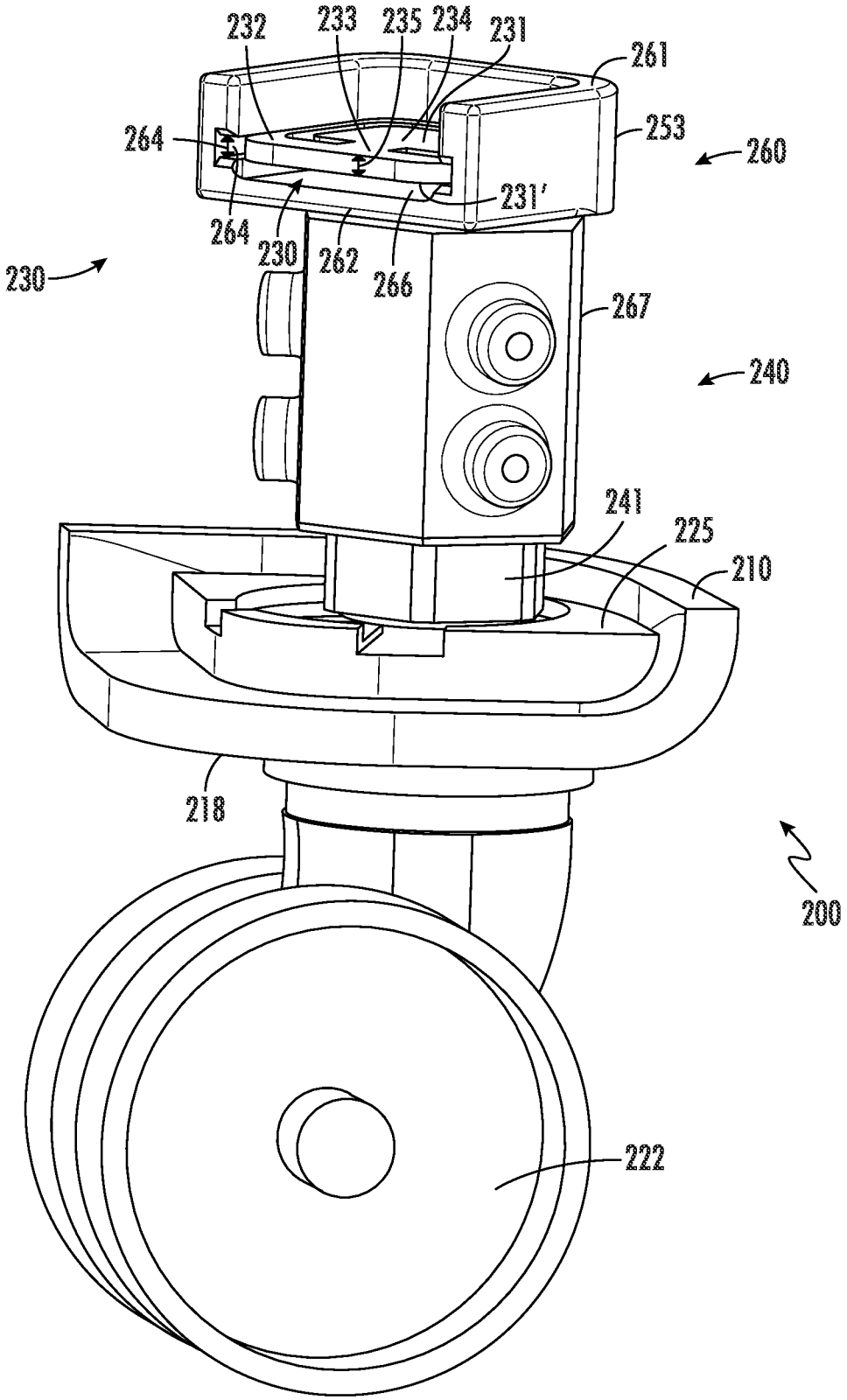
FIG. 15 is a perspective view of another embodiment of a sensor assembly according to the luggage unit of the present invention.
Figure 16:
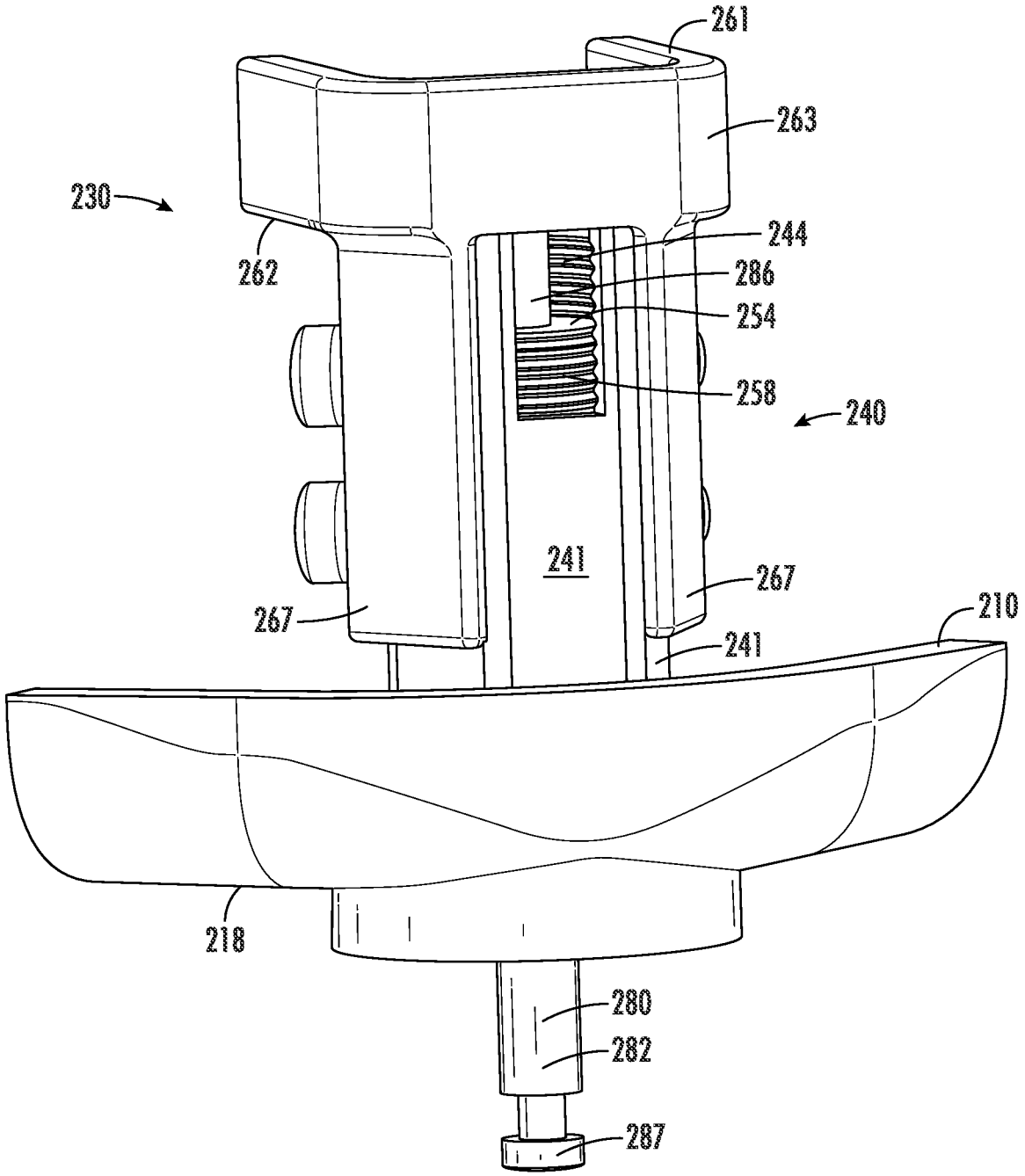
FIG. 16 is a perspective view of the back of a further embodiment of the sensor assembly according to luggage unit of the present invention.
Figure 17:
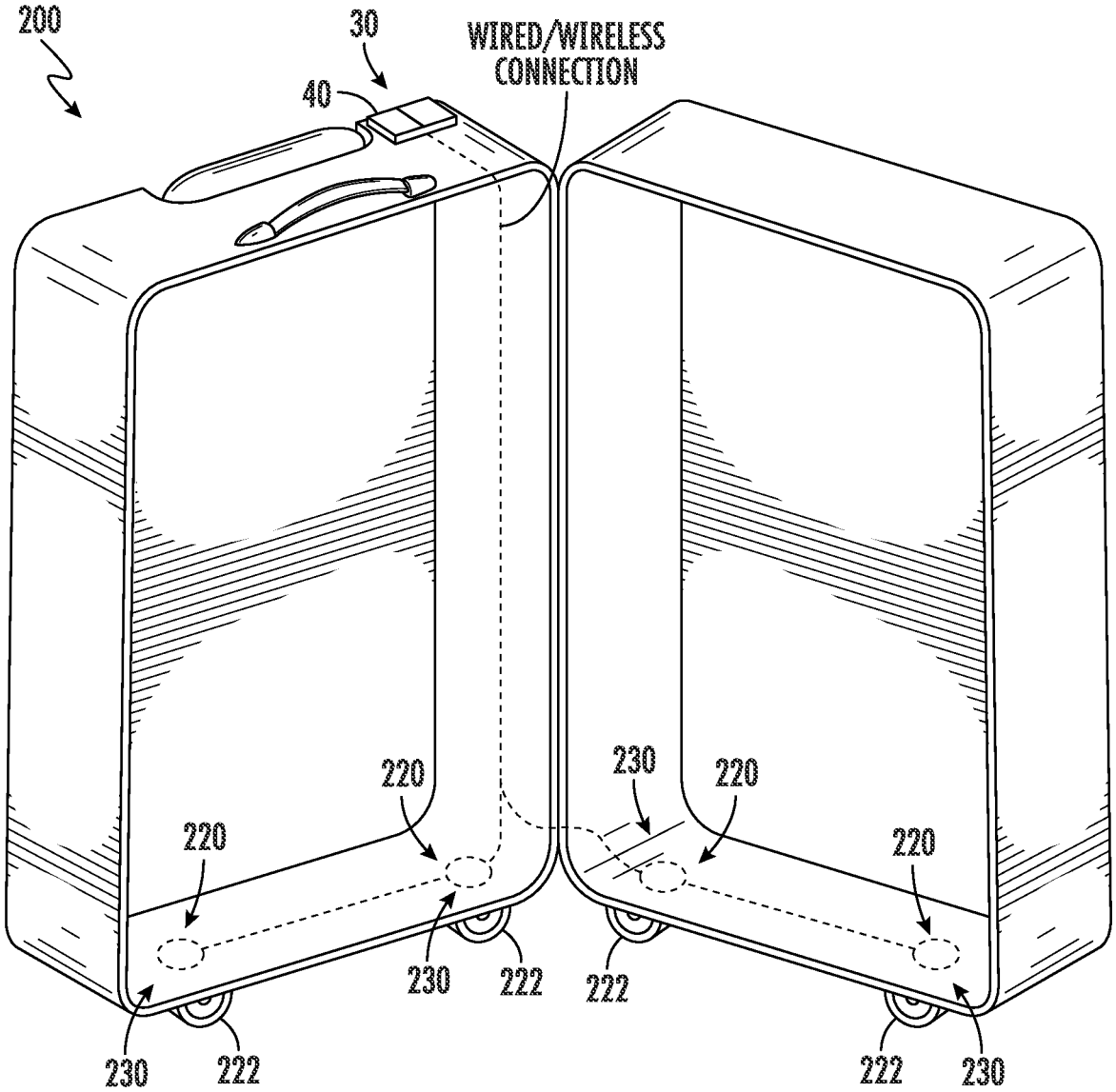
FIG. 17 is a perspective view of a one embodiment of the luggage unit according to the present invention showing the operative connections between the sensor assemblies of the detection assembly according to the luggage unit of the present invention.

With reference now to FIGS. 13-17, the present invention is also directed to a unit of luggage 200 configured to ascertain its own weigh. The innovative unit of luggage 200 comprises a detection assembly 220 with a plurality of sensor assemblies 230, each one comprising at least one load cell sensor 231. The unit of luggage 200 according to the present invention may comprise various of the operative components described above, but also comprises a plurality of sensor assemblies 200, indicated at 230 with a variety of components that enable operation of various load cell sensors 231 to ascertain at least a portion of the weight of the unit of luggage 200 when it is disposed on a substantially upright or operative position. As such, and as is represented in the previous figures, the unit of luggage may comprise a case 200 with a plurality of wheels disposed thereon, e.g., on a bottom portion thereof as represented in FIGS. 1-4. As is perhaps best represented in FIG. 15, it is within the scope of the present invention that each one of the plurality of wheels comprise a corresponding sensor assembly 230 connected to or at least adjacently disposed thereon. For example, the illustrative embodiment of FIG. 15 shows a sensor assembly 230 disposed above a corresponding one of the plurality of wheels 222 of the unit of luggage 200. It is within the scope of the present invention that each sensor 231 be operatively connected with a processing unit, e.g., as shown at 40 in FIG. 11, which may be operatively disposed within the case 210, e.g., within a service assembly 30.

Further, and with reference to at least FIG. 11, an operative connection between the sensor 231 and the processing unit 40 and/or the service assembly 30 as described herein may be enabled by a plurality of wired connections, e.g., disposed on the interior of the case 210, or enabled via wireless technologies, including, without limitation Bluetooth®, Wi-Fi, LAN, Near-Field Communication (NFC) capabilities, and other related tools. As an example, as shown in the illustrative embodiment of FIGS. 13 and 15, a microprocessor or microcontroller may be operatively disposed within the load cell sensor 231 and may be operatively structured to interpret a reading from the sensor 231 and communicate such reading to the service assembly 30 and/or processing unit 40.

As is perhaps best represented in FIG. 14, the sensor assembly 230 generally comprises a housing assembly 240 and a shaft 280 disposed thereon. The housing assembly 240 may be disposed on a structure, e.g., 225, that attaches it to the case 210, or may be directly disposed on the case 210. The housing assembly 240 generally comprises a sensor housing 261, a cylinder housing 241, and a cylinder 250. The sensor housing 261 generally comprises a sidewall 263. The sidewall 263 is generally configured and dimensioned to form an enclosure area 263" around the sensor 231. For example, as is represented in at least FIGS. 14 and 15, the enclosure area 263" may comprise a polygonal or semi-polygonal shape that at least partially, or sometimes fully, encloses the sensor 231.

As may also be appreciated from FIGS. 13-15, the sidewall 263 may comprise a slot 264 disposed or otherwise formed around a bottom portion 263' of the sidewall 263. For example, the slot 264 may be formed on an interior side of the sidewall 263. The slot 264 may comprise a thickness 265, which is generally structured and dimensioned to correspond to the thickness of the sensor 231, including a thickness 235 of a base 232 thereof. As shown in FIGS. 13-14, the base 232 may surround the stem 234 but may be disposed in a space apart relation thereto outside of the point of connection or intersection 233. As such, an upward force may cause the stem 234 to deflect upward with respect to the base 232. In addition, a barrier 266 may be provided below the slot 264 and/or sensor 231 around the bottom portion 263' of the sidewall 263. The barrier 266 may comprise an opening 266' disposed around a middle section thereof and a dimension that is at least greater than that of an upper section 285 of the shaft 280. The barrier 266 may also be disposed in a substantially transverse alignment to the sidewall 263. As such, as is perhaps best represented in the illustrative embodiment of FIG. 13, the sidewall 263 may be configured to enclose the sensor 231 defining an operative position with respect to the rest of the components of the sensor assembly 230.

With reference again to at least FIG. 14, the cylinder housing 241 is generally disposed below the barrier 266 of the sensor housing 260. The cylinder housing 241 may comprise a covering structure or sleeve 267 disposed below the barrier 267. The covering structure 267 is generally structured and dimensioned to at least partially enclose the cylinder housing 241. The sensor housing 261 and the cylinder housing 241 are generally disposed in non-movable relation to one another, although this is not strictly required. Furthermore, the sensor housing 261 and the cylinder housing 241 may be formed as an integral and/or unitary component. Moreover, as may be appreciated from at least FIG. 14, the sensor housing 261 is generally configured and dimensioned to enclosed the cylinder housing 241. For example, as may be appreciated form the illustrative embodiment of FIG. 14, the cylinder housing 241 is generally disposed around a proximal end 242 thereof, including adjacent to a bottom side of the barrier 266. In turn, the cylinder housing 241 is generally connected to at least a portion of the case 210, e.g., around a distal end 243 thereof. Accordingly, at least the cylinder housing 241 and the sensor housing 261 are operatively connected to the case 210 such that the sensor housing 261 and the cylinder housing 241 may reciprocate a movement of the case 210, e.g., upward or downward, according to its own weight.

With further reference to at least FIG. 14, the cylinder 250 may be disposed within the cylinder housing 241. Generally, the cylinder housing 241 may comprise a substantially hollow interior such that it may accommodate the cylinder 250 in an inside thereof. As such, both the cylinder housing 241 and the cylinder 250 may comprise substantially cylindrical configurations or substantially cylindrical cross-sectional shapes and may be collectively configured and dimensioned such that the cylinder 250 may be inserted within the cylinder housing 241. As may be also appreciated from FIG. 14, the cylinder 250 generally comprises a hollow interior such that it may enclose the shaft 280. For example, the cylinder 250 may comprise an opening 253 that defines an interior surface 250' of the cylinder 250. The interior surface 250' of the cylinder 250 may also comprise a substantially cylindrical geometry structure to accommodate the shaft 280 on the inside of the cylinder 205. The interior surface of the cylinder 250 may also permit a vertical movement of the shaft 280 within the hollow interior of cylinder 250, upward or downward within the space indicated at 288.

As may also be appreciated in FIG. 14, the shaft 280 may comprise a substantially elongated shape with a middle section 284, an upper section 285 and a lower section 286. The upper section 285 may be disposed around a proximal end 281 of the shaft 280, whereas the lower section 286 may be disposed around a distal end 282 thereof. The upper section 285, the middle section 284 and the lower section 286 collectively define a length 283 of the shaft 280. Each of the middle section 284, upper section 285 and lower section 286 may comprise a substantially cylindrical shape, but with different diameters. For example, the diameter 284' of the middle section 284 may be greater than the diameter 285' of the upper section 285. As a further example, the diameter 284' of the middle section 284 may also be greater than the diameter 286' of the lower section 286. As an even further example, the diameter 286' of the lower section 286 may be greater than the diameter 285' of the upper section 285. As such, the middle section 284 of the shaft 280 may be at least partially disposed within the interior of the cylinder 250 and may have sufficient space, i.e., as shown at 288 within the interior of the cylinder 250, to move upward or downward between a top portion 284" of the middle section 284 of the shaft 280 and the bottom side 256 of the cylinder cap 254, which itself may be disposed around a proximal end 251 of the cylinder 250, and which will be described in more detail below. It should be appreciated from a review of FIG. 14 that in this illustrative embodiment the shaft 280 is in its lowest intended position within the cylinder 250, where a bottom side of the middle section 284 is disposed in confronting relation to a retaining structure 276 of a stopper 270, which will also be described in more detail below. As such, the shaft 280 may travel from such lowest position to a position where the top portion 284" of the middle section 284 is disposed in confronting relation to the bottom side or underside of the cap 254.

With even further reference to at least FIG. 14, it is contemplated when the case 210 is disposed in a substantially vertical position, e.g., substantially aligned with the vertical plane and/or Y-axis, that its own weight, including with contents disposed therein, that the case 210 will move downward with respect to the position of the shaft 280 and each of the wheels 222 of the unit of luggage 200. As used herein, a "substantially vertical position" refers to an alignment of at least the center of the shaft 280 with respect to the vertical plane or Y-axis. Further, it is contemplated that the cylinder 250 will also reciprocate the movement of the case 210 given that it is generally disposed in non-movable relation with respect to the cylinder housing 241. In turn, a downward movement of the case 210 due to its weight, will result in a corresponding and reciprocal movement of the various components of the housing assembly 240 with respect to the shaft 280 and according to the movement of the case 210. Said differently, both of the cylinder 250, the cylinder housing 241, the sensor housing 261 as well as the stopper 270 should reciprocally move with the case 210 with respect to the shaft 280 according to the weight and contents disposed thereon. Nonetheless, the shaft 280 and the wheels 222 are intended to remain in their actual vertical position with respect to the ground as well as the case 210 and the components of the housing assembly 240. As such, the housing assembly 240 and the case 210 are configured to move independently from the shaft 280.

As a result, as the unit of luggage 200 is loaded with additional content, which increases the weight of the case 210, the cylinder 250 may move further downward relative to the shaft 280 within the interior of the cylinder 250. Such downward motion of the cylinder 250, as well as the cylinder housing 241 and the sensor housing 261 with respect to the shaft 280 and the wheels 222, which are intended to remain in their position, will cause the upper section 285 of the shaft 280 to come into contact with the underside 231' of the sensor 231. In turn, as the sensor assembly 240 and the sensor 231 move further downward with respect to the shaft 280, this further movement in the vertical direction will induce a perpendicular force on the sensor 231, which induces a stress on a stem 234 of the sensor. Such induced stress is proportional to the downward distance of travel of the housing assembly 240 and the sensor 231 with respect to the shaft 280. Such induced stress is also indicative, for example after calibration of the sensor 231, of a portion of the weight of the unit of luggage 200, i.e., the case 210 with contents disposed therein.

Additional features of the present invention comprise providing cylinder 250 and a shaft 280 that are cooperatively configured and dimensioned to enable a frictional resistance between them. As represented in FIG. 14, the cylinder 250 may comprise an opening 253 with a sufficient diameter to accommodate the diameter 284' of the middle section 284 of the shaft. As such an exterior surface 284"' of the middle section 284 of the shaft 280 may be disposed in confronting relation to the interior surface 250' of the cylinder thereby enabling a frictional resistance between these two surfaces 284"' and 250'. The frictional resistance generated between the two surface 284"' and 250' should be sufficient to attenuate or otherwise at least partially diminish the distance that the shaft 280 travels within the interior of the cylinder 250 according to the weight of the case 210. Said differently, an equal amount of weight of the case 210 should result in a lesser distance of vertical travel of the shaft 280 within the interior of the cylinder 250 than would otherwise occur without such frictional resistance. However, such frictional resistance between the interior surface 250' of the cylinder 250 and the outer surface 284"' of the middle section 284 should still permit some movement, albeit at least partially reduced, of the shaft 280 within the cylinder 250 such that the sensor 231 may detect a stress that is associated with a vertical deflection of the stem 234 of the sensor 231, and which is representative of at least a portion of the weight of the case 210 and/or unit of luggage 200. By way of example only, the frictional resistance between the interior surface 250' of the cylinder 250 and the outer surface 284"' of the middle section 284 may reduce the distance of travel of the shaft 280 within the cylinder 250 by a factor of about 5 to 20.

With even further reference to the illustrative embodiment of FIG. 14, even additional features of the present invention may comprise providing a stopper 270 operatively disposed within the case 210. The stopper 270 may also comprise a shape structured and/or adapted to prevent a vertical downward movement of the shaft 280 relative to the housing assembly 240 and the case 210 beyond an intended distance. For example, it is generally contemplated that the middle section 284 of the shaft 280 should not move outside of the cylinder 250 in the upward direction, and that it should also not move outside of the stopper 270 in the downward direction. Accordingly, the stopper 270 may comprise retaining structures 274, 276 and/or 276' structured and dimensioned to connect the stopper 270 to the case 210 and/or to retain the middle section 284 of the shaft 280 within the case 210. However, as seen in the in the illustrative embodiment of FIG. 14, at least a portion of the lower section 286 is intended to extend outside of the stopper 270 and/or the bottom part 218 of the case 210. This is done intentionally, such that a connecting portion, i.e., shown at 287, may be disposed around a distal end 282 of the shaft 280 to attach it to the corresponding wheel 222 of the unit of luggage 200.

Thus, a lower section of the stopper 278 may comprise an opening 278' structured and dimensioned to retain the middle section 284 of the shaft 284. For example, the diameter 279 of the opening 278' of the lower section 278 of the stopper 270 may correspond, i.e., may be at least greater, than the diameter 286' of the lower section 286 of the shaft 280. As a further example, the diameter 279 of the opening 278' of the lower section 278 of the stopper 270 may be smaller than the diameter 284' of the middle section 284 of the shaft 280 in order to retain it. Further, the stopper 270 may comprise an opening 271 around its upper portion configured and dimensioned to enclose at least the middle section 284 of the shaft 280. The opening 271 may comprise a diameter structured and dimensioned to enclose the middle section 284 of the shaft above its lower section 278. As such, both the interior of the cylinder 250 and the interior of the stopper 270 may collectively define an enclosure channel of the shaft 280, wherein at least the middle section 284 may travel upward or downward according to the weight of the case 210. Further, it is within the contemplation of the present invention that the shaft 280 according to the present invention be able to rotate about the Y-axis within the interior of the cylinder 250. This may be advantageous to allow a reciprocal rotational movement of the wheel 222 that is attached around the connecting portion 287.

As is further shown in FIG. 14, further features of the present invention comprise providing a plurality of mating structures that may secure the various components of the housing assembly 240 to one another and with respect to the case 210. For example, the interior of the cylinder housing 241 may be provided with a first mating structure 244, e.g., deposed around its proximal end 242 thereof, as well as a second mating structure 245, e.g. disposed around its distal 243 end thereof. The cylinder cap 254 may be provided with a mating structure 258, e.g., disposed around an exterior surface of the cap 254. The stopper 270 may also be provided with a mating structure 272 around an exterior or outside surface thereof. As such, the mating structure 258 of the cap 254 may form a mating engagement with the first mating structure 244 of the cylinder housing 241. Further, the mating structure 272 of the stopper 270 may form a mating engagement with the second mating structure 245 of the cylinder housing. By way of example, these mating structures, e.g., 244, 245. 258 and/or 272, may be provided with threaded configurations such that they may define threaded, mating engagements between. Such threaded configurations may also allow for positional adjustments in the vertical direction, upward or downward, of the cylinder 250 with respect to the cylinder housing 241. For example, such positional adjustments may be achieved by rotating the cylinder 250 within the interior of the cylinder housing 241. As a further example, the position of the stopper 270 relative the case 210 as well as the cylinder housing 241 may also be adjusted in the vertical direction by rotating the stopper 270 within the case 210.

As may be also appreciated from a review of FIG. 14, the cylinder cap 254 may be configured and dimensioned such that a top side 255 thereof may be adjacently disposed to the underside of the barrier 266 when the cylinder is disposed in its highest position within the cylinder housing 241. As such, the barrier should prevent the cap 254 as well as the cylinder 250 from exiting the cylinder housing 241. Also, the cap 254 may also be provided with an opening 257 configured and dimensioned to enclose the upper section 285 of the shaft 280. Similarly, the cylinder 250 should comprise an opening 259 with a diameter 259' structured and dimensioned to enclosed the middle section 284 of the shaft 280. In addition, the stopper 270 should prevent the distal end 252 of the cylinder from exiting the cylinder housing 241. In addition, further mating structures and/or connecting mechanisms may be provided between the stopper 270 and the case 210 to enable a secure attachment between them. In lieu of threaded configurations, other mechanisms may also be provided to secure the various components of the housing assembly 240 to one another and to the case, including without limitation connectors, screws, bolts, glue, snap on mechanisms, clamps, etc.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A unit of luggage configured to ascertain its own weight, the unit of luggage comprising:

a case comprising a plurality of wheels disposed thereon, a detection assembly comprising a plurality of sensor assemblies, each one of the plurality of sensor assemblies being adjacently disposed to a corresponding one of the plurality of wheels, each one of the plurality of sensor assemblies comprising:

a housing assembly, a sensor comprising a stem and a base connected to one another, a shaft disposed within the housing assembly and connected around a distal end thereof to a corresponding one of the plurality of wheels, the shaft being adjacently disposed to a bottom side of the sensor, the housing assembly comprising:

a sensor housing comprising a sidewall and a barrier, the barrier disposed on a bottom portion of the sidewall, the sidewall configured to define an enclosure area on an interior thereof, the sensor disposed within the sensor housing on the interior of the sidewall, a cylinder comprising a hollow interior and configured to enclose the shaft, the cylinder configured to permit a reciprocal movement of the shaft within the hollow interior, a cylinder housing adjacently disposed to the sensor housing and configured to at least partially enclose the cylinder, at least a portion of the cylinder housing being connected to the case, a cap disposed on a proximal end of the cylinder the barrier configured and dimensioned to prevent a vertical movement of the can and the cylinder outside of the cylinder housing, the cylinder hosing comprising a first mating structure disposed around a proximal end thereof and the cap comprising a mating structure; the first mating structure of the cylinder housing and the mating structure of the can collectively configured and dimensioned to define a mating engagement between them, each of the first mating structure of the cylinder housing and the mating structure of the cap comprising threaded configurations collectively configured and dimensioned to enable a rotational, upward and downward movement of the can and the cylinder with respect to the cylinder housing, a processing unit operatively disposed within the case, the shaft, the cylinder, the cylinder housing and the sensor housing collectively configured and dimensioned to allow a movement, at least in a downward direction, of the case with respect to the shaft when the case is disposed in a substantially upright position, and the sensor operatively configured with the processing unit to ascertain at least a portion of the weight of the unit of luggage when the case is disposed in the substantially upright position.

2. A unit of luggage configured to ascertain its own weight, the unit of luggage comprising:

a case comprising a plurality of wheels disposed thereon, a detection assembly comprising a plurality of sensor assemblies, each one of the plurality of sensor assemblies being adjacently disposed to a corresponding one of the plurality of wheels, each one of the plurality of sensor assemblies comprising:

a housing assembly, a sensor comprising a stem and a base connected to one another, a shaft disposed within the housing assembly and connected around a distal end thereof to a corresponding one of the plurality of wheels, the shaft being adjacently disposed to a bottom side of the sensor, the housing assembly comprising:

a sensor housing comprising a sidewall and a barrier, the barrier disposed on a bottom portion of the sidewall, the sidewall configured to define an enclosure area on an interior thereof, the sensor disposed within the sensor housing on the interior of the sidewall, a cylinder comprising a hollow interior and configured to enclose the shaft, the cylinder configured to permit a reciprocal movement of the shaft within the hollow interior, the cylinder housing being disposed within the sensor housing;

a cylinder housing adjacently disposed to the sensor housing and configured to at least partially enclose the cylinder, at least a portion of the cylinder housing being connected to the case, a processing unit operatively disposed within the case, the shaft, the cylinder, the cylinder housing and the sensor housing collectively configured and dimensioned to allow a movement, at least in a downward direction, of the case with respect to the shaft when the case is disposed in a substantially upright position, and the sensor operatively configured with the processing unit to ascertain at least a portion of the weight of the unit of luggage when the case is disposed in the substantially upright position.

3. The unit of luggage as recited in claim 2 wherein the sensor comprises a load cell sensor.

4. The unit of luggage as recited in claim 2 wherein an interior surface of the cylinder is cooperatively configured with an exterior surface of the shaft to enable a frictional resistance therebetween that at least partially diminishes the reciprocal movement of the shaft within the hollow interior of the cylinder.

5. The unit of luggage as recited in claim 2 wherein the shaft, the cylinder, the cylinder housing and the sensor housing are collectively configured and dimensioned to allow a controlled downward movement of at least the case with respect to the shaft when at least the shaft is substantially aligned with the Y-axis.

6. The unit of luggage as recited in claim 2 wherein the sidewall and the barrier are collectively configured to allow an at least partially upward movement of the stem of the sensor with respect to the base of the sensor when the case is disposed in the substantially upright position.

7. The unit of luggage as recited in claim 2 wherein the cylinder housing is disposed below the sensor housing.

8. The unit of luggage as recited in claim 2 wherein the sensor housing and the cylinder housing are disposed in non-movable relation to one another.

9. The unit of luggage as recited in claim 2 wherein the sensor housing and the cylinder housing are formed as an integral component.

10. The unit of luggage as recited in claim 2 wherein the sensor is disposed above the barrier around a bottom portion of the sidewall; the sidewall and the barrier disposed in a substantially perpendicular alignment to one another.

11. The unit of luggage as recited in claim 2 wherein the cylinder is configured to enclose the shaft and permit a reciprocal movement of the shaft, upward and downward, within the cylinder.

12. The unit of luggage as recited in claim 2 wherein the sensor housing further comprises a covering structure disposed below the sidewall; the covering structure configured and dimensioned to at least partially enclose the cylinder housing.

13. The unit of luggage as recited in claim 2 wherein a proximal end of the shaft is disposed in confronting relation to the bottom side of the sensor.

14. A unit of luggage configured to ascertain its own weight, the unit of luggage comprising:

a case comprising a plurality of wheels disposed thereon, a detection assembly comprising a plurality of sensor assemblies, each one of the plurality of sensor assemblies being adjacently disposed to a corresponding one of the plurality of wheels, each one of the plurality of sensor assemblies comprising:

a housing assembly, a load cell sensor comprising a stem and a base connected to one another, a shaft disposed within the housing assembly and connected around a distal end thereof to a corresponding one of the plurality of wheels, the shaft being adjacently disposed to a bottom side of the sensor, a stopper disposed between the shaft and the case; the stopper configured to at least partially limit movement of the shaft outside of the case, the housing assembly comprising:

a sensor housing comprising a sidewall and a barrier, the barrier connected to a bottom portion of the sidewall, the sidewall configured to define an enclosure area on an interior of the sidewall, the sensor disposed within the sensor housing on the interior of the sidewall, a cylinder comprising a hollow interior and configured to enclose the shaft, the cylinder configured to permit a reciprocal movement of the shaft, upward and downward, within the hollow interior; an interior surface of the cylinder being cooperatively configured with an exterior surface of the shaft to enable a frictional resistance between them that at least partially diminishes a reciprocal movement of the shaft within the hollow interior of the cylinder, a cylinder housing adjacently disposed to the sensor housing and configured to at least partially enclose the cylinder, at least a portion of the cylinder housing being connected to the case, a processing unit operatively disposed within the case, the shaft, the cylinder, the cylinder housing and the sensor housing collectively configured and dimensioned to allow a controlled movement of at least the case with respect to the shaft when the case is disposed in a substantially upright position, and the sensor being operatively configured with the processing unit to ascertain at least a portion of the weight of the unit of luggage when the case is disposed in the substantially upright position.

15. The unit of luggage as recited in claim 14 wherein the stopper is operatively disposed between the shaft, the case and the cylinder housing; the stopper configured a least partially limit movement of the shaft outside of the housing below the case.

16. The unit of luggage as recited in claim 14 wherein the stopper comprises a mating structure and the cylinder housing comprises a second mating structure; the second mating structure of the cylinder housing and the mating structure of the stopper are collectively configured and dimensioned to define a mating engagement between them.

17. The unit of luggage as recited in claim 16 wherein each of the second mating structure of the cylinder housing and the main structure of the stopper comprise threaded configurations structured and dimensioned to enable a rotational, upward and downward, movement of the stopper with respect to the cylinder housing.

18. The unit of luggage as recited in claim 14 wherein the cylinder comprises a cap disposed on a proximal end of the cylinder; the barrier configured and dimensioned to at least partially limit a vertical movement of the cap outside of the cylinder housing.

19. The unit of luggage as recited in claim 14 wherein the shaft comprises a middle section, an upper section and a lower section; the middle section configured and dimensioned to correspond to the size of the hollow interior of the cylinder; the upper section configured and dimensioned to correspond to the size of an opening of the barrier.

20. The unit of luggage as recited in claim 19 wherein each of the middle section, upper section and lower section of the shaft comprise a substantially cylindrical configuration; a diameter of the middle section of the shaft being greater than a diameter of the upper section of the shaft and a diameter of the lower section of the shaft.

21. The unit of luggage as recited in claim 20 wherein the cap comprises an opening; the diameter of the middle section of the shaft being greater than a diameter of the opening of the cap; the cap being structured to prevent a vertical movement of a top portion of the middle section of the shaft above the cylinder housing.

22. The unit of luggage as recited in claim 19 wherein a lower portion of the stopper comprises an opening and a retaining structure disposed thereon; the diameter of the middle section of the shaft being greater than the diameter of the opening of the lower portion of the stopper.

23. The unit of luggage as recited in claim 22 wherein the stopper is structured to at least partially enclose the middle portion of the shaft; the diameter of the opening of bottom portion of the stopper being less than the diameter of the middle portion of the shaft; the retaining structured configured and dimensioned to prevent a downward movement of the middle portion of the shaft below the case.

24. A unit of luggage configured to ascertain its own weight, the unit of luggage comprising:

a case comprising a plurality of wheels disposed thereon, a detection assembly comprising a plurality of sensor assemblies, each one of the plurality of sensor assemblies being adjacently disposed to a corresponding one of the plurality of wheels, each one of the plurality of sensor assemblies comprising:

a housing assembly, a sensor comprising a stem and a base connected to one another, a shaft disposed within the housing assembly and connected around a distal end thereof to a corresponding one of the plurality of wheels, the shaft being adjacently disposed to a bottom side of the sensor, the housing assembly comprising:

a sensor housing comprising a sidewall and a barrier, the barrier disposed on a bottom portion of the sidewall, the sidewall configured to define an enclosure area on an interior thereof, the sensor disposed within the sensor housing on the interior of the sidewall, the sensor housing further comprising a slot formed on the inner interior of the sidewall around a bottom portion thereof; the slot being configured and dimensioned to substantially correspond to a thickness of the base of the sensor; the base of the sensor operatively disposed within the slot;

a cylinder comprising a hollow interior and configured to enclose the shaft, the cylinder configured to permit a reciprocal movement of the shaft within the hollow interior, a cylinder housing adjacently disposed to the sensor housing and configured to at least partially enclose the cylinder, at least a portion of the cylinder housing being connected to the case, a processing unit operatively disposed within the case, the shaft, the cylinder, the cylinder housing and the sensor housing collectively configured and dimensioned to allow a movement, at least in a downward direction, of the case with respect to the shaft when the case is disposed in a substantially upright position, and the sensor operatively configured with the processing unit to ascertain at least a portion of the weight of the unit of luggage when the case is disposed in the substantially upright position.

25. A unit of luggage configured to ascertain its own weight, the unit of luggage comprising:

a case comprising a plurality of wheels disposed thereon, a detection assembly comprising a plurality of sensor assemblies, each one of the plurality of sensor assemblies being adjacently disposed to a corresponding one of the plurality of wheels, each one of the plurality of sensor assemblies comprising:

a housing assembly, a sensor comprising a stem and a base connected to one another, a shaft disposed within the housing assembly and connected around a distal end thereof to a corresponding one of the plurality of wheels, the shaft being adjacently disposed to a bottom side of the sensor, the housing assembly comprising:

a sensor housing comprising a sidewall and a barrier, the barrier disposed on a bottom portion of the sidewall, the sidewall configured to define an enclosure area on an interior thereof, the sensor disposed within the sensor housing on the interior of the sidewall, a cylinder comprising a hollow interior and configured to enclose the shaft, the cylinder configured to permit a reciprocal movement of the shaft within the hollow interior, a cylinder housing adjacently disposed to the sensor housing and configured to at least partially enclose the cylinder, at least a portion of the cylinder housing being connected to the case, a stopper operatively disposed between the shaft, the cylinder housing and the case; the stopper configured to at least partially limit movement of the shaft outside of the housing below the case;

a processing unit operatively disposed within the case, the shaft, the cylinder, the cylinder housing and the sensor housing collectively configured and dimensioned to allow a movement, at least in a downward direction, of the case with respect to the shaft when the case is disposed in a substantially upright position, and the sensor operatively configured with the processing unit to ascertain at least a portion of the weight of the unit of luggage when the case is disposed in the substantially upright position.

* * * * *